US012708813B2

(12) United States Patent
Perre et al.

(10) Patent No.: US 12,708,813 B2
(45) Date of Patent: Aug. 18, 2026

(54) VENTILATION DEVICE, SYSTEM INCLUDING THE VENTILATION DEVICE, AND USES THEREOF

(71) Applicant: BATHYSMED, Bouillante Guadeloupe (FR)

(72) Inventors: Karl Perre, Marignane (FR); Pierre Michelet, Marseilles (FR); Frédéric Beneton, Rennes (FR); Jean-Marie Delamarre, Marseilles (FR); Vincent Meurice, Bouillante Guadeloupe (FR)

(73) Assignee: BATHYSMED, Bouillante Guadeloupe (FR)

( * ) Notice: Subject to any disclaimer, the term of this patent is extended or adjusted under 35 U.S.C. 154(b) by 294 days.

(21) Appl. No.: 18/013,948

(22) PCT Filed: Jul. 2, 2021

(86) PCT No.: PCT/EP2021/068415
§ 371 (c)(1),
(2) Date: Dec. 30, 2022

(87) PCT Pub. No.: WO2022/003193
PCT Pub. Date: Jan. 6, 2022

(65) Prior Publication Data

US 2023/0285800 A1 Sep. 14, 2023

(30) Foreign Application Priority Data

Jul. 2, 2020 (EP) ..... 20305746

(51) Int. Cl.
*A63B 23/18* (2006.01)
*A63B 71/06* (2006.01)

(52) U.S. Cl.
CPC ..... *A63B 23/185* (2013.01); *A63B 71/0622* (2013.01); *A63B 2071/0638* (2013.01)

(58) Field of Classification Search
CPC ..... A63B 23/185; A63B 23/18
See application file for complete search history.

(56) References Cited

U.S. PATENT DOCUMENTS

| | | | | |
|---|---|---|---|---|
| 9,452,317 | B2 | 9/2016 | Arkush | |
| 9,579,060 | B1 * | 2/2017 | Lisy | A61B 5/165 |
| 2008/0053452 | A1 * | 3/2008 | Brown | A61M 16/0006 128/207.12 |
| 2009/0264255 | A1 * | 10/2009 | Tutsch | A63B 23/18 482/13 |

(Continued)

FOREIGN PATENT DOCUMENTS

| | | | |
|---|---|---|---|
| WO | WO-2017071879 A1 * | 5/2017 | A61M 16/021 |
| WO | WO 2018/011358 | 1/2018 | |
| WO | WO 2020/028637 | 2/2020 | |

*Primary Examiner* — Nyca T Nguyen
(74) *Attorney, Agent, or Firm* — SALIWANCHIK, LLOYD & EISENSCHENK

(57) ABSTRACT

This invention relates to a device for ventilating a subject and a system comprising such a device, in particular a virtual reality system. It also relates to a kit comprising such a device or system, as well as a virtual reality content attached to a computer medium. The invention also relates to the applications liable to be made of these devices, system and kit, particularly in the medical, well-being and gaming fields.

6 Claims, 12 Drawing Sheets

(56) References Cited

U.S. PATENT DOCUMENTS

Figure 1:
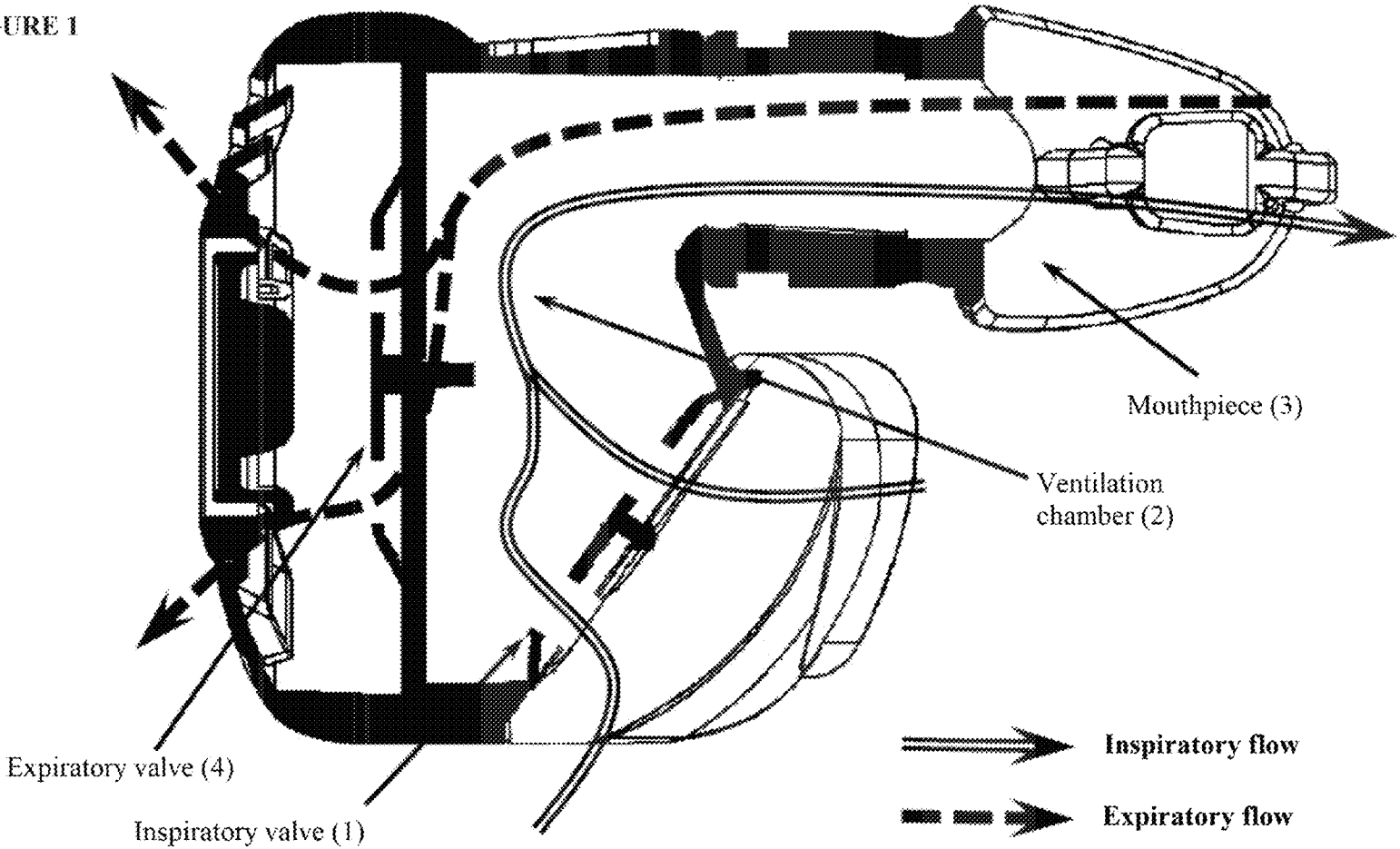

| | | | | |
|---|---|---|---|---|
| 2011/0124470 | A1* | 5/2011 | Spurling | A63B 23/18 482/13 |
| 2012/0085347 | A1 | 4/2012 | Iyer et al. | |
| 2016/0192893 | A1* | 7/2016 | Gutzeit | A61B 8/481 600/407 |
| 2016/0287139 | A1 | 10/2016 | Luttrell | |
| 2018/0272189 | A1 | 9/2018 | Lee | |
| 2019/0134460 | A1 | 5/2019 | Cheu et al. | |
| 2019/0299055 | A1* | 10/2019 | Poulsen | A63B 23/18 |
| 2020/0054921 | A1* | 2/2020 | Costella | A61M 16/205 |
| 2020/0246659 | A1* | 8/2020 | Davis | A63B 24/0062 |
| 2020/0251071 | A1* | 8/2020 | Eromaki | G09G 5/12 |
| 2021/0001169 | A1* | 1/2021 | Roussel | A61M 16/201 |
| 2021/0086883 | A1* | 3/2021 | Coulange | B63C 11/24 |
| 2022/0022772 | A1* | 1/2022 | Adams | A63B 23/18 |
| 2022/0168613 | A1* | 6/2022 | Boutros | A61M 16/20 |
| 2023/0338691 | A1* | 10/2023 | Valiyambath | A61M 16/0683 |
| 2023/0338775 | A1* | 10/2023 | Rutten | A63B 21/015 |

* cited by examiner

A

B

C

VENTILATION DEVICE, SYSTEM INCLUDING THE VENTILATION DEVICE, AND USES THEREOF

CROSS-REFERENCE TO RELATED APPLICATION

This application is the U.S. national stage application of International Patent Application No. PCT/EP2021/068415, filed Jul. 2, 2021.

This description relates to a device for ventilating a subject and a system comprising such a device. It also relates to a kit comprising such a device or system as well as a virtual reality content attached to a computer medium. The inventors also describe the possible applications of these devices, system and kit, in particular in the medical, well-being and gaming fields.

The invention is typically used to put the subject in a state receptive to sensory stimulation. It is advantageously used, in particular in a therapeutic environment, to put the subject using it in a state of heart coherence.

PRIOR ART

The level of "perceived stress" perceived by a subject is a result of the imbalance between the "perceived constraints" and the "perceived resources" perceived by the subject (Cohen S et al. (1983, 2007). This level is associated with a high risk of this subject to develop an anxio-depressive pathology.

Post-Traumatic Stress Disorder ("PTSD") has been known since Antiquity but its psychological manifestations only began to be really taken into consideration after the Vietnam war. The "Post-Vietnam Syndrome" resulted in PTSD being included in the DSM (Diagnostic and Statistical Manual of Mental Disorders). It has been recognized at international level in the ICD (International Classification of Diseases) since 1992. It is currently applicable to the after-effects of war but also to disorders following disasters, accidents, assaults and terrorist attacks which have become recurrent in recent decades (Shalev A et al.). PTSD follows confrontation with a "violent", "usually sudden", "unexpected" and "exceptional" event. This disorder is characterized by a quartet of symptom types including i) a repetition syndrome (flashbacks), entailing excessive sympathetic discharges, ii) avoidant behavior (Wachen J S et al.), iii) hypervigilance due to hyperactivity of the sympatho-vagal balance (Stephenson et al.), and iv) cognitive and behavioral disorders also identified by the terms "cognitive and emotional dysfunctions" (Wachen J S et al.). The subject with PTSD exhibits a genuine reorganization of his brain function, particularly as regards emotional regulation (problems of self-compassion, rumination guilt, anger, etc.). This mechanism can be indirectly observed by the recording of the variability of the heart rate which reflects its impact on the neurovegetative system. The outcome of PTSD is usually favorable (50% at 1 month, 30% at 3 months). However, in 20% of cases, it can become chronic despite approved therapeutic care.

"Burn-Out" is a condition related to stress in the work environment. Originally associated with caregiving occupational categories (social workers, medical workers etc.), it is now recognized as affecting all types of jobs. The first researches on workplace exhaustion syndrome are attributed to the psychiatrist and psychotherapist Herbert Freudenberger, in 1974. However, the concept of burn-out was formulated as early as 1959 by the Frenchman Claude Veil.

The disorder is triggered following constant and prolonged exposure to work-related stress. It is more generally associated with jobs involving a high degree of mental, emotional and affective demands, positions of responsibility, or where goals are difficult or impossible to achieve. Individuals who exhibit a high degree of commitment to their work are particularly at risk. If burn-out initially causes behavioral symptoms such as irritability, loss of energy, anger, inability to face tension, the disorder are liable to become aggravated and accompanied by major psycho-social risks (Khirreddine I et al.). Given these findings, Haute Autorité de Santé (HAS) has published a report in March 2017 wherein it proposes a definition of burnout and good practice recommendations aimed at occupational doctors and general physicians (Repérage and prise en charge cliniques du syndrome d'épuisement professionnel ou burnout. aute Autorité de Santé: 2017 March). Thus, standardized evaluations [see for example the "Maslach Burnout Inventory" (MBI)] revealed high frequencies of this syndrome among healthcare professionals (Moukarzel et al.).

Inattention, insomnia, impatience and lack of motivation are noted. Some individuals also experience various types of pain (constant cold symptoms, stomachache etc.) At the psychological level, this can cause a loss of self-esteem, a state of sadness and anxiety. Four phases of burn-out can be identified: 1) the warning phase, which is a manifestation of the stress: 2) the resistance phase, during which the metabolism adapts to the sensations of stress (the body becomes more resistant): 3) the rupture phase, which triggers the reappearance of the characteristic stress reactions of the warning phase, except that its reactions are then irreversible (chronic stress); and 4) the exhaustion phase, which manifests as a loss of psychological defenses and constant anxiety.

Many divers, both healthy and ill, testify to the benefits associated with the practice of diving on their overall condition. Well ("healthy") divers and "µl" divers, for example those suffering from depression, post-traumatic stress disorder ("PTSD"), "burn-out" or attention deficit disorder with or without hyperactivity (ADHD), describe an improvement in their ability to resist stress, manage their anxiety and/or the quality of their sleep. Kent et al. (1994) report an "Improvement in well-being and stress levels in the control group of a study on decompression accidents". Experimental studies conducted on rats show the appearance of persistent neurochemical modifications (dopaminergic function, regulation of the glutamate/GABA ratio) following repeated exposure of subjects tested at narcotic depths (Lavoute C et al., 2005 and Lavoute C et al., 2012).

First, the inventors demonstrated that the practice of diving on a daily basis for one week improves stress levels (perceived stress), mood and well-being among stressed active subjects. This effect is maintained at one month (Beneton F. et al.). These benefits are greater than those observed by the practice of another physical activity under similar conditions of practice. The action mechanisms of the singular effects of diving could imply better emotional regulation via the involvement of deep and regular breathing (relaxation/sophrology: mindful meditation), a reinforcement of bodily anchoring and awareness of each moment (mindful meditation). As regards these behaviors, the practice of diving is similar to mindful meditation training and these behaviors are conventionally associated with better regulation of emotional pathways (Hariri A. R. et al.) and stress (Greeson J. M. et al.) involving an improvement of the regulation of the autonomic nervous system (ANS) via the reinforcement of the parasympathetic (vagal) system (Ditto B. et al.).

Secondly, the inventors were able to report significant benefits of non-narcotic diving including sophrology/mindful meditation exercises in subjects suffering from Post-Traumatic Stress Disorder. This particular diving protocol, referred to as the BATHYSMED protocol, is described in the experimental part of this description. These studies involved victims of the Paris terror attacks, (DIVHOPE study) then military personnel suffering from the same disorder (COGNIDIVE study). In each of these studies levels of Post-Traumatic Stress were significantly reduced by comparison with the control groups.

The inventors are also conducting a study on the benefits of this BATHYSMED diving protocol among emergency room personnel exhibiting a high level of risk of Burn Out when evaluated by the MBI.

The prior art describes a device controlled by a software program allowing both respiratory training and training of the respiratory muscles (see patent U.S. Pat. No. 9,452,317), a respiratory device combining a game and respiratory therapy (see patent application US2019/134460), a system making it possible to train its user in the appropriate diaphragmatic breathing technique for a medical condition input by an operator (see patent application WO2020/028637) or else a respiratory therapy instrument comprising a box provided with a printed circuit board and a data transmitter, a tube for the airway and a pair of pressure sensors in communication with said tube, capable of measuring the pressure inside the tube linked to the pulmonary flow (during expiration or inspiration), the collected data being used in a game (see patent application US2016/0287139). However, at present no device exists making it possible to replicate, or ideally improve, the therapeutic benefits obtained using the practice of diving and/or mindful meditation, typically allowing its user to achieve a state of heart coherence and/or to increase his heart rate variability, for example outside an aquatic environment.

SUMMARY OF THE INVENTION

The invention in particular relates to a device (A) for ventilating a subject, said device comprising an oral or oronasal endpiece (a) or an orofacial mask (a), at least one valve (b) advantageously configured to generate an inspiration pressure between 0 and 10 mbar of resistance and an expiration pressure between 1 and 12 mbar of resistance, preferably two separate valves, i.e. an inspiration valve (b') configured to generate an inspiration pressure between 0 and 10 mbar of resistance, and an expiration valve (c) configured to generate an expiration pressure between 1 and 12 mbar of resistance. The configuration of the valve (b), or of the valves (b') and (c), thus imposes on the subject an expiratory effort greater than his inspiratory effort. The pressure values indicated above, and throughout the description, are expressed as absolute values: those skilled in the art will understand that during inspiration, the pressure exerted on the valve is negative, whereas during expiration, it is positive.

In a preferred embodiment, the ventilation device (A) further comprises at least one sensor (d) for acquiring data, for example a pressure sensor and/or a flow rate sensor. It may also comprise one or more sensors (d) for detecting and measuring (variations in) at least one physiological parameter of the subject, preferably selected from among respiratory frequency, a respiratory volume, the expiratory capnia (amount of $CO_2$ expired), cardiac frequency (or heart rate), heart coherence, sympatho-vagal balance and the electrical activity of an organ.

In a preferred embodiment, the invention relates to a system (X) comprising the ventilation device (A) and a device (Z) for receiving, storing, processing and/or transmitting data acquired by the ventilation device (A), typically by the sensors (d) of the device (A).

The invention also relates to a particular system (X), the so-called "virtual reality system (Y)", comprising a ventilation device (A) according to the invention and preferably also a device (Z) (i.e. a system (X)), as well as a tool (B) for viewing a virtual reality content and/or an audio module (D) for listening to a virtual reality content. The tool (B) for viewing a virtual reality content typically comprises a screen and lenses. Advantageously, the tool (B) comprises an integrated operating system or is connected to a tool for playing a virtual reality content (C).

The device (A), the system (X) or the system (Y) according to the invention preferably comprises an audio module (D). In a particular embodiment, the audio module (D) comprises an audio file reader (f) and/or a memory card (g).

The system (X) or the system (Y) can also further comprise a means (H) for modulating the temperature of all or part of the scalp by means of a liquid or a gas and/or a means (I) for delivering or generating electrical impulses across all or part of the scalp of the subject.

In a particular embodiment, the audio module (D) of the system (Y) comprises an audio file reader (f) and a memory card (g): the system (A) comprises a pressure and/or flow rate sensor (d) which delivers a signal; and the device (Z) comprises a processor or a microcontroller (e) which:

i) analyzes the signal delivered by the pressure and/or flow rate sensor (d) by comparing the pressure level with at least two previously determined pressure thresholds, ii) transmits a signal to the audio file reader (f) which triggers or stops the reading of the first or second sound file according to the inspiratory or expiratory nature of the ventilation phase in which the subject is, by adapting the intensity of the sound volume according to the difference between the two previously determined thresholds, and preferably iii) records the signals delivered by the sensor (d) and/or transmitted to the audio file reader (f).

The invention also relates to a kit comprising a device (A), a system (X) or a system (Y) as described by the inventors, and a virtual reality content attached to a computer medium.

In a particular embodiment, the invention relates to the use of a device (A), an audio module (D), a system (X), a system (Y) or a kit as described by the inventors to simulate a non-invasive ventilation, for example in a therapeutic embodiment.

The invention also relates to the use of a device (A), an audio module (D), a system (X), a system (Y) or a kit as described by the inventors, to stimulate, for example, scuba diving, a flight, for example an aeronautical or space flight, a voyage, a visit to a place of interest or the virtual world of an electronic game.

The description further pertains to the use of a device (A), an audio module (D), a system (X), a system (Y) or a kit as described by the inventors, or such a device (A), audio module (D), system (X), system (Y) or kit for a use, in the prevention or treatment in a subject of a disease or disorder related to stress or anxiety, a symptom of said disease or of said disorder, and/or migraine in the subject, in particular to allow the subject to reach a state of heart coherence or, in other words, to allow him to increase his heart rate variability. The device (A), audio module (D), system (X), system (Y) or kit may be used alone or in combination with one or more gases and/or one or more active molecules used in the prevention or treatment of the disease, disorder, symptom of said disease or of said disorder and/or migraine.

The description also pertains to a method for preventing or treating, in the subject, a disease or disorder related to stress or anxiety, a symptom of said disease or of said disorder, and/or migraine, characterized in that the method comprises the use of a device (A), a system (X), a system (Y), or a kit, as described in this text, to prevent or treat the disease, disorder and/or migraine in the subject, alone or in combination with one or more gases and/or one or more active molecules used in the prevention or treatment of the disease, disorder, symptom of said disease or of said disorder and/or migraine.

The therapeutic effect can be directly shown by the detection of the heart coherence, or in other terms, by the detection of an increase in the heart rate variability and a reduction in the respiratory frequency, in subjects using a device according to the invention.

DETAILED DESCRIPTION OF THE INVENTION

Meditation is known for its positive impact in terms of pain reduction, improvement of the immune system, reduction of stress, feelings of depression, anxiety, anger and confusion. It increases the blood flow and heart rate, helps to control thoughts, provides a feeling of calm, peace and balance, increases energy levels and decreases the risks of heart disease.

On the psychological front, individuals in a "mindful" state, for example individuals practicing "mindful meditation", are able to free themselves from the stream of consciousness to concentrate deeply on the present moment. They are thus capable of keeping their mind focused on lived experience for longer. An improved consciousness of their body allows them to be more attentive to the feelings experienced, more self-aware, more open to the outside world, and in a position of acceptance and non-judgement. This state decreases the level of stress perceived by the individual while increasing the perception he has of his resources, thus improving his ability to manage stresses (Trousselard M. et al.). Similar benefits to those observed in individuals practicing mindful meditation have been observed by the inventors on individuals practicing diving. On the physiological front, the latter have a controlled ventilation and a state of heart coherence, the positive impact of which on the equilibrium of the nervous system has been demonstrated (Beneton F. et al.). Finally, positive effects were reported among healthcare professionals as regards induced stress, but with the question of the persistence of the positive effects in relation to continuation of the therapies (Ruiz-Fernández M D et al.).

"Heart coherence" is a personal emotional and stress management practice which consists in breathing exercises. It is described as bringing about many benefits for physical, mental and emotional health. It is a physiological stress control technique used to reach a particular state of equilibrium of the cardiac frequency/heart rate (pulse) or "heart rate variability" (i.e. capability of the heart to speed up or slow down in order to adapt to its environment), known as a "state of heart coherence". Having nearly 40 000 neurons as well as a complex and dense network of neurotransmitters, the heart communicates directly with the brain. By acting on the heart rate via breathing exercises, it is thus possible to send positive messages to the brain. Heart coherence allows the individual who practices it to learn to control his breathing in order to regulate his stress and anxiety. Achieving a state of heart coherence for example allows subjects suffering from PTSD to increase their heart rate variability, ideally to stabilize their heart rate beyond the period during which the breathing exercises are done ("persistence" of the positive effects). The state of heart coherence is also described as making it possible to reduce depression and blood pressure.

The body is governed by two major nervous systems, the somatic system (voluntary actions) and the autonomic system (automatic regulation). The heart actively participates in the autonomic nervous system, in which it performs an essential function allowing adaptation to environmental change. A heart in good condition has a high heart rate variability.

The autonomic nervous system is partitioned into two sub-systems: the sympathetic and the parasympathetic. The sympathetic one triggers all the actions needed for fight or flight but also the acceleration of the heart and respiratory frequency as well as the dilation of the pupils and the inhibition of digestion. The parasympathetic one meanwhile promotes recovery, relaxation, rest, repair, etc. Inspiration stimulates the sympathetic system while expiration stimulates the parasympathetic system. Since breathing is controlled by the autonomic nervous system as well as by the somatic nervous system, it is possible to control the autonomic nervous system by this route.

It is for example possible to reach the desired equilibrium state (the state of heart coherence) by breathing six times per minute (inspiration and expiration of 5 seconds each). This breathing frequency specifically makes it possible to reach the respiratory frequency of 0.1 Hertz (physiological constant specific to humans). The state of heart coherence induces immediate effects with an increase in heart rate variability associated with calming, medium-term effects (over periods of several hours—see Heckenberg R A, Eddy P, Kent S, Wright B J., J Psychosom Res. 2018 November: 114:62-71) with neuro-hormonal modifications (for example reduction of stress hormones) and more long-term effects (over several months, for example at least two, three, four, five or six months) with for example reductions in cardiovascular or neuropsychological risk. The increase in the amplitude of the heart variability and a state of calm can be observed immediately. In the longer term, a decrease in blood pressure and cardiovascular risk can be observed, a better recovery, improved concentration and memory, a decrease in attention disorders and hyperactivity, better pain tolerance, and, where applicable, an improvement in the symptoms of asthmatic diseases and inflammatory symptoms.

The use of mindful meditation programs shows benefits on PTSD symptoms (Jayatunge R M et al.), depression-related suffering and quality of life, particularly in chronic forms of PTSD. These improvements are even greater when the practice is regular, which underlines the importance of the practicing arrangements as well as the commitment of the patient. Finally, meditation appears more effective than simple breathing (relaxation) techniques. However, meditating requires concentration.

And the ability to concentrate depends on the state of inner peace which is lacking in patients suffering from hypervigilance and flashbacks. It is also necessary for the subject to be able/in a state to decide to take care of himself and to open himself up to the experience, but a patient suffering from PTSD perceives the world as threatening and his behaviors are usually influenced by a lived experience of self-accusation, guilt and/or shame. It is again for the subject to cultivate the intention to initiate and maintain the necessary motivation for regular meditative practice, but subjects suffering from PTSD usually also suffer from depression.

It is moreover recognized that practicing sport is beneficial for health and emotional regulation. More precisely, physical activity has indisputable advantages for the prevention and treatment of mental illness related to anxiety. Physical activity is also associated with somatic benefits, particularly cardiovascular ones. In the context of PTSD, recent data are encouraging and therefore favorable to the practice of sport.

At first, the inventors sought to find out whether or not leisure diving was able to induce or reinforce the mindful functioning of stressed subjects and improve their quality of life. In this context, the inventors developed an innovative protocol combining non-narcotic scuba diving (i.e. less than 20 meters in depth) with mindful meditation ("Bathysmed"—see experimental part) and studied ("DIVSTRESS" Study) 37 volunteers divided into two separate groups, the members of one of the groups taking a diving course including a program of ten sessions (including one dive per day over 10 days) while the members of the other group practiced sporting activities other than diving in the context of a UCPA course, also of ten days. They allowed the tested individuals belonging to the group of divers to reach a mindful state and observed in them beneficial effects on stress, anxiety and mood, with the benefits maintained over a period of at least one month after the completion of the course (Beneton F. et al.).

Subsequently, the inventors were able to report the positive effects of this Bathysmed diving protocol among victims of the Paris terror attacks of 13 Nov. 2015 and suffering from PTSD ("DIVHOPE" Study). The inventors were able to correlate this state in particular to the unusual and silent underwater environment. They then showed a reactivation of the parasympathetic system by way of slow and deep ventilation. As observed by the inventors, diving made it possible to reduce feelings of guilt and shame in stressed subjects, in particular in depressive subjects and in subjects suffering from PTSD. Its entertaining aspect also made it possible to counteract lack of motivation, which is common among depressive subjects. In particular it made it possible to improve the effectiveness of mindful meditation by facilitating its practice, by potentiating its effects and by improving its observance. The same positive effects were reported among military personnel suffering from PTSD following the conflicts in Afghanistan and *Mali* ("COGNIDIVE" study).

Secondly, the inventors managed to induce, outside an aquatic environment, the beneficial respiratory effects observed in the "Bathysmed" study, described above in the individuals who used the device and tools forming the subject of this invention, described in this text. In particular, they managed to replicate in these subjects a state of mindfulness and heart coherence directly associated with a measurable decrease in heart rate and spontaneous respiratory frequency and a decrease in capnia (rate of $CO_2$ expired): the heart rate thus went from 72±13 beats per minute to 64±5 beats per minute: the respiratory frequency went from 15±5 cycles per minute to 11±4 over a period of 5 minutes. Capnia was reduced to 35±5 to 33±3 mm Hg following an increase of the tidal respiratory volume of 584±86 ml to 1100±382 ml, in the same time interval (see Example 1). All these modifications were spontaneously induced in the test subjects using the ventilation device (A) according to the invention independently of any intention or deliberate action of the test subjects.

The invention also relates in particular to a ventilation device (A) of a subject. This device typically comprises an oral or oronasal endpiece or an orofacial mask (a) and at least one valve (b) advantageously configured to generate an inspiration pressure between 0 and 10 mbar of resistance and an expiration pressure between 1 and 12 mbar of resistance, preferably two separate valves, i.e. an inspiration valve (b) configured to generate an inspiration pressure between 0 and 10 mbar of resistance, and an expiration valve (c) configured to generate an expiration pressure between 1 and 12 mbar of resistance, the configuration of said valve (b) or said valves (b) and (c) being ideally performed under physiological conditions ideal for the subject. This configuration of the valve (b), or the valves (b') and (c), advantageously makes it possible to impose on the subject using the device (A) an expiratory effort greater than his inspiratory effort. The inspiratory and expiratory flows are hence differentiated.

The pressure values indicated throughout the description are expressed as absolute values: those skilled in the art will understand that during inspiration the pressure exerted on the valve is negative, whereas during expiration, it is positive.

This device is typically intended to be used on land or in the air. It is preferably intended to be used on land, i.e. neither in an aquatic environment nor in air, and under normal pressure conditions, i.e. approximately one atmosphere (1 atm, or 1.013 bar or 101 325 Pa).

In a particular embodiment, the device can be used under pressurized air conditions, for example in a hyperbaric tank.

The oral endpiece (a) (mouth endpiece or "mouthpiece") is typically an endpiece of snorkel endpiece type, or preferably an endpiece for a scuba regulator, for example a scuba regulator endpiece of the type and volume currently in existence.

The oronasal endpiece (a) is for example an endpiece of the type used in hospital or aeronautical environments allowing adaptation to the physiology of children (who breath much more spontaneously and easily through the nose) or the anatomy-physiology of some adult individuals.

The endpieces described above typically comprise a gas intake tube and possibly applicable bite tabs.

The orofacial mask (a) is for example a mask of the type used in first aid (insulating breathing apparatus), in aquatic environments (mass-market diving facemask) or in a medical context (such as a non-invasive ventilation mask).

Advantageously the device (A) is non-invasive, i.e. it does not involve any endotracheal device such as intubation or tracheotomy.

The breathed gas (respiratory gas) is preferably air, typically ambient air, the device being intended to be used, preferably, on land and under normal pressure conditions of atmospheric pressure (1 atm), typically outside an aquatic environment. In this case, the gas comes directly from the outside environment in which the subject using the device (air surrounding the user) is located.

The breathed gas can also be air enriched with oxygen or be a gas mix, the composition of which can be adapted according to specific purposes (addition of inhaled therapies, specific fragrances etc.) In this case, instead of coming from the outside environment, the gas may come from one or more cylinders of respiratory gas.

When the gas is directly taken from the outside environment, it is typically the inspiration or expiration of the subject which controls the opening of a means of valve type (b), also identified as a "two-way pressure and flow rate control valve", which makes it possible to let the gas pass through, typically from the outside of the device (A) toward the oral or oronasal endpiece during inspiration, or from the inside of the device (A) toward the outside of said device during expiration.

The function of these valves can be broken down into two sub-functions: the driving of the direction of the flow crossing the valve (one- or two-way), and the management of the overpressurization or depressurization necessary to allow the gas flow to pass.

In a particular embodiment, the valve (b) is driven "automatically" by a device appended to the system (A) such as the system (Z) described below. In a particular embodiment, the device (A) comprises two separate valves, typically an inspiration valve (b) and an expiration valve (c) (also identified as "one-way pressure and flow rate valves"), which can be one and/or the other driven (automatically) by a device appended to the system (A) such the system (Z) described below.

When the gas comes from a cylinder, the inspiration or expiration of the subject controls the opening of the valve which allows the gas to pass from a chamber located in the device (A) into the oral or oronasal endpiece during inspiration, or from the inside of the device (A) to the outside of said device during expiration.

The valve (b) or the inspiration (b) and expiration (c) valves is/are configured to regulate the breathing of the subject, preferably to slow down his breathing (his ventilation cycle) by imposing on him an expiratory effort greater (by at least one 1 mbar as explained below) than his inspiratory effort. The valve (b) or inspiration valve (b') is thus configured to generate an inspiration pressure (associated with the inspiratory flow), typically between 0 and 10 mbar of resistance and the valve (b) or expiration valve (c) is configured to generate an expiratory pressure (associated with the expiratory flow) between 1 and 10 mbar of resistance.

The expiratory pressure (associated with the expiratory flow) is of necessity positive.

The inspiration pressure (associated with the inspiratory flow) is on the contrary of necessity a "depressurization" such that the range of values expressed as an absolute value above, can also be described as neutral or negative and, expressed as a real value, as typically between 0 and −10 mbar. The respiratory pressure, in particular the inspiration pressure or the expiration pressure, is the pressure exerted inside the airways of the subject typically during the periods of inspiration (inspiration pressure) or expiration (expiration pressure). The positive expiratory pressure is therefore the expiratory pressure maintained within the airways of the subject during the expiration phase.

Preferably the respiratory pressure difference imposed on the subject by the (two-way) valve or by each of the (one-way) valves of inspiration (b') and expiration (c), is of at least one 1 mbar, for example of 3 mbar.

The inspiration pressure can be between 0 and 10 mbar of resistance. It is in particular between 1 and 10 mbar of resistance. It is preferably between 0 or 1 mbar and 3 or 4 mbar, for example between 1 mbar and 3 mbar, between 1 mbar and 2 mbar or between 2 mbar and 3 mbar.

The expiration pressure (systematically positive) may be between 1 and 10 mbar of resistance. It is typically between 2, 2.5 or 3 mbar and 10 mbar of resistance, for example 2.5 mbar and 4 or 5 mbar, between 3 mbar and 4 mbar, between 4 mbar and 5 mbar, between 5 mbar and 6 mbar or between 6 mbar and 7 mbar.

In order to regulate the gas pressures during inspiration and/or during expiration, the ventilation device advantageously comprises a means for modulating, in a controlled manner, the pressure exerted on the valve serving to control the gas stream, typically of ambient air, during inhalation [valve (b) or inspiration valve (b)] and/or during expiration of the subject [valve (b) or expiration valve (c)]. This valve is typically a one-way valve acting on the inspiratory outlet (inspiration check valve), typically a valve (b'), or expiratory (expiration check valve), typically a valve (c), of the ventilation device (A).

The means for modulating the pressure exerted on the valve can be a brake configured to exert a stress, preferably adjustable, on the valve, typically on the one-way valve, in order to control the pressure of the gas coming from the inspiratory inlet or that of the gas coming from the expiratory outlet, in such a way as to generate a neutral or negative pressure in the case of the inspiration pressure, and systematically positive in the case of the expiration pressure, and in such a way as to govern/control the value of this pressure when it is positive.

According to a particular embodiment of the invention, the brake can be a valve with a flexible membrane. The opening pressure/depressurization value of the valve can be modulated by adjusting the value of the Shore hardness of the membrane.

According to another particular embodiment of the invention, the brake can be a one-way diaphragm assembly (see FIG. 9A), also known as a "membrane and diaphragm valve". This type of brake modulates the pressure as a function of the flow rate.

According to yet another particular embodiment of the invention, the brake can be a one-way butterfly valve assembly (see FIG. 9C). The one-way valve defines the direction of passage of the flow and the butterfly valve makes it possible to modulate the section of passage of the flow and therefore to regulate the pressure as a function of the flow rate.

According to another particular embodiment of the invention, the brake can be provided with a breathing resistance spring associated with a tapping screw. A particular example is a tared spring valve (see FIG. 9B), also known as a "tared discharge valve".

According to another particular embodiment of the invention, the brake can be an electrovalve. This latter can be controlled/driven electronically following measurements provided by a pressure sensor.

More generally, the means, typically the brake, can take any form making it possible to vary the level of shuttering of the outlet surface, and is advantageously slaved to a computer or processor accessible to the subject.

In a particular embodiment, the means making it possible to modulate the pressure exerted on the valve or valves within the device (A) is implemented/controlled by a computer.

The ventilation device (A) can allow the generation of several, for example two, three or four levels of positive expiration pressure, selected for example from among the pressure levels of 1; 2; 2,5; 3; 3,5; 4; 4,5; 5; 5,5; 6; 6,5; 7; 7,5; 8; 8,5; 9; 9,5 and 10 mbar.

These positive expiration pressure values, given by way of non-limiting example, correspond to the levels making it possible to sufficiently slow down the breathing of a human being to allow him to attain, or maintain (preferably, in the case of a therapeutic application, during a long enough period to obtain a detectable effect/therapeutic benefit), the desired state of equilibrium, i.e. the state of heart coherence.

In a particular embodiment, the ventilation device (A) is a second stage of a diving regulator or a simulator of a second stage of a diving regulator.

In a particular embodiment, the ventilation device (A) described by the inventors comprises at least one sensor (d) for acquiring data, for example at least one pressure sensor and/or one flow rate sensor (d). The sensor makes it possible to capture data/parameters emanating from the subject using the device (A), typically physiological data. A pressure and/or flow rate sensor thus allows the measurement of the pressure and/or the flow rate of the breathed gas (inspired or expired), preferably expired gas, by the subject.

In the context of this invention, the term "sensor" denotes a means that measures a physical quantity and preferably translates it into a signal. The quantity in question can for example be pressure, respiratory flow rate, respiratory frequency, a volume, for example lung volume, or an electrical activity. The transmitted signal is generally an electrical signal but can also be optical or electromagnetic. According to a particular embodiment, the sensor (d) is a pressure and/or flow rate sensor and is advantageously composed both of an element sensitive to the pressure and/or flow rate of the respirated gas and of at least one means for converting this information into an output signal, for example a flow rate or pressure sensor associated with an electronic module for converting this information into an output signal, for example a flow rate or pressure sensor module associated with an electronic module for converting the physical quantity into an electrical signal.

This signal, once processed, preferably by a processor (a microcontroller) (e), makes it possible to electronically adapt the operation of the device, module, means or system described for the first time by the inventors in this text, for example of the ventilation device (A), preferably automatically.

In a preferred embodiment of the invention, for example of a system (X) or of a system (Y) according to the invention as described in this text, the ventilation device (A) thus also comprises one or more additional sensors (d') for detecting and/or measuring at least one, preferably at least two physiological parameters of the subject, typically separate from the parameter measured by the sensor (d), for example selected from among respiratory frequency, a respiratory flow rate, a lung volume, capnia, and an electrical activity.

In a particular embodiment the ventilation device (A) comprises one or more sensors of the position of the head, limbs, body or eyes (such as accelerometer or optical gyrometers), for detecting/studying for example the behavior of the body in relation with the simulation session. Similarly, the data collected can be re-used in the field of gaming to correlate/improve the correlation of the movements of the body in relation with the script of a particular game.

The invention also relates to a system (X) comprising a ventilation device (A) as described for the first time by the inventors in this text, and a device (Z) for receiving, storing, processing and/or transmitting data acquired by the device (A), typically by the sensor or sensors associated with the device (A), such as physiological data/parameters of the subject using said device (A).

In a preferred embodiment, the device (Z) is an autonomous box comprising an external power supply (J) and/or an internal battery (m), preferably accompanied by, or able to be connected to, a recharging device: a processor or microcontroller (e): a stop-start switch; and/or a recording module (n), either internal, for example a storage unit of SD-micro SD type, or external (K), for example a computer; and, preferably at least one operating LED.

In a particular embodiment, the device (Z), the system (X), the system (Y) or the audio module (D) further comprises a recording module (n) for example a microSD module, preferably driven/controlled by the microprocessor (e) so that it records the variation over time of the sensed signal in a usable format (for example a ".txt" text file), preferably on a removable storage medium (for example a microSD card). The recorded file can also be transmitted via wireless communication (Wi-Fi or Bluetooth) to a storage medium.

When it is connected to an audio module (D), the device (Z) allows the synchronization of the detected ventilation cycle using the sensor(s) located in the ventilation device (A) by triggering the playing of a sound classified as inspiratory and/or expiratory and/or of a soundtrack (the inspiratory and/or expiratory sound(s) can be mixed with the soundtrack when the device (Z) or the audio module (D) comprises a sound adjusting and/or mixing system (mixer/amplifier) (o), for example simulating a scuba dive, an aeronautical flight and/or a space flight.

Thus, for example in the case of the simulation of a scuba dive, the inspiratory and expiratory sounds played, perceived by the user of the device, correspond to the sounds perceived by a subject actually making a scuba dive and using a diving regulator. The sound of the emission of gas bubbles in water is thus for example perceived when the subject expires using the device.

The audio module (D) combined with the ventilation device (A) promotes the establishment of a state of heart coherence in the user subject, who will unconsciously adjust his breathing/respiratory cycle, i.e. on the one hand his inspiration and on the other hand his expiration, to the sounds perceived in order to be in phase with them ("audio visualization" by the subject of the phases of the respiratory cycle). The combination of said means therefore facilitates the use of the device and the observance of a protocol as described in this text, for example a therapeutic protocol (for the direct benefit of the patient subject).

The inventors also describe a virtual reality system (Y) comprising a ventilation device (A) or a system (X) according to the invention as well as a tool (B) for viewing a virtual reality content and/or an audio module (D) for listening to a virtual reality content.

The system (Y) according to the invention allows its user to artificially replicate a sensory experience including hearing (sound experience) and/or sight (visual experience), as well as preferably the position in space, and ideally also touch (tactile experience), particularly feelings of hot/cold, and/or smell (olfactory experience). It thus allows the user to be "immersed" in a virtual reality. As described above in relation to the audio module (D), the combination or two or more of these means promotes the establishment of a state of heart coherence in the user subject who will unconsciously regulate his breathing/respiratory cycle, i.e. on the one hand his inspiration and on the other hand his expiration, to the perceived sounds and images. The combination of several means, in particular of the device (A), of a tool (B) and of an audio module (D), therefore facilitates the use of said device, or more generally of the virtual reality system (Y), and therefore the observance of a protocol as described in this text, for example a therapeutic protocol (for the direct benefit of the patient subject).

The audio module (D) comprises, or is connected to typically, an apparatus (R) comprising at least one headphone or loudspeaker, preferably two headphones or loudspeakers, one for each ear, and makes it possible to return sound content. Each headphone contains inside it at least one transducer capable of replicating all the audible frequencies, or at least most of them. It is typically integrated and/or connected to the ventilation device (A), to the device (Z) (i.e. to the system (X)) and/or to a tool (B) (i.e. to the virtual reality system (Y)) for viewing a virtual reality content.

The apparatus (R) comprising at least one headphone or loudspeaker, preferably two headphones or loudspeakers, is typically selected from among an audio headset, one or more headphones and one or more earpieces, where applicable intra-auricular (with or without wireless). The name "headset" comes from the fact that the two earphones (at least one earphone, preferably both, being active or activatable) are connected by a headband that surrounds the head of the listening user.

It makes it possible to broadcast one or more sounds, for example a sound identical or similar to a sound generated during the experience to be simulated (as explained above in relation to the example of scuba diving), a voice message and/or music.

In a particular preferred embodiment, the audio module (D) comprises, or is connected to, preferably a means for reducing or cancelling surrounding noise and/or playing a sound identical or similar to a sound generated during the experience to be simulated, for example during the use of a scuba diving regulator, typically under real diving conditions.

The sound played is preferably a stereophonic sound (i.e. the sound played reconstitutes the distribution in space of the original sound sources). This sonic relief is typically obtained using two channels (left and right) played by at least two transducers, one for each ear. Under ideal conditions, the listening user hears the sounds as he would in nature or as if he was located facing the orchestra during a concert.

When the simulated experience is a scuba dive, the means for playing a sound identical or similar to a sound generated during the experience to be simulated preferably plays at least the sound generated during the use of a scuba diving regulator under real diving conditions, or a sound similar thereto.

The means for reducing the surrounding noise is preferably a means which continuously measures, compares and processes the ambient noise to cancel it by emitting an opposing signal, for example.

The audio module (D) is connected to a sound source, for example by way of a jack connector. According to a preferred particular embodiment, the audio module (D) comprises a wireless connection.

It is for example equipped with a receiver of radio or infrared waves, or even Bluetooth or Wi-Fi to communicate with a base connected to the audio source.

In a particular preferred embodiment, the audio module (D), typically the audio module (D) of the system (Y), comprises, or is connected to, a means for reducing or cancelling surrounding noise and/or playing a sound identical or similar to a sound generated during the use of a scuba diving regulator: the ventilation device (A) comprises at least one sensor (d): the device (Z) is connected to the sensor(s) (d) of the ventilation device (A) and to the audio module (D); and the audio module (D) is used to play the inspiratory and expiratory sounds in a way that is synchronized with the ventilation of the subject.

In a particular embodiment, the audio module (D) comprises a processor or a microcontroller (e), an audio file reader (f) and/or a memory card (g), a system for adjusting and/or mixing sound (o) and, preferably, an audio input and output.

In another particular embodiment, the audio module (D) comprises an audio file reader (f) and/or a memory card (g), a system for adjusting and/or mixing sound (o) and, preferably, an audio input and output.

The processor or microcontroller (e) makes it possible to i) analyze the signal received by a sensor (d), for example a sensor (d) located inside the ventilation device (A), of the system (X) and/or of the system (Y), typically by comparing the value of the received signal with a reference value or interval of values, for example a level of pressure exerted by a respiratory gas on a valve or a level of respiratory gas flow rate, and, after the analysis, ii) transmits a signal to a receiver, for example to an audio file reader (f). This signal transmitted comprises the instructions for triggering or stopping the reading of a particular sound file, selected for example as a function of the inspiratory or expiratory nature of the ventilation phase (which comprises the inspiration phase, the expiration phase and the respiratory pause between the two phases) in which the subject is. The measured pressure level is for example compared to at least two previously determined pressure thresholds. The signal also preferably includes the instructions for adjusting the intensity of the sound volume as a function of the difference between the two previously determined thresholds. Preferably, the sound volume is higher when the value of the signal is close to the value of the previously determined threshold, and conversely, the sound volume is lower when the value of the signal moves away from the previously determined threshold value.

The processor or microcontroller (e) is located according to a particular embodiment in the audio module (D). In another particular embodiment, the processor or microcontroller (e) is located in the device (Z), the system (X) or the system (Y), and independent of the audio module (D), for example appended to the ventilation device (A).

In a particular embodiment, the audio file reader (f) reads, from the signal received from the processor or microcontroller (e), one of the sound files stored on an audio memory card (g) and generates an audio stream sent to the mixer/amplifier (o). The audio memory card (g) preferably comprises several sound files, for example a first sound file for playing an inspiratory sound and a second sound file for playing an expiratory sound.

The audio signal corresponding to the sound files of a breathing sound can be mixed with another audio signal (for example music accompanying a film viewed by the user of the system (Y) via a virtual reality headset) delivered by a secondary audio source(S) connected to the audio module.

In a particular embodiment, the audio module (D) comprises at least one potentiometer (p), preferably two potentiometers (p and q) (for example stereo logarithmic potentiometers). These can be used to independently adjust the sound level of each signal. As indicated previously, the audio module can furthermore comprise a mixer/power amplifier (i.e. the system for adjusting and/or mixing sound (o)) which transmits the resulting processed (blended/mixed and/or amplified) signal to the headphones, for example to an audio headset (R).

In a particular embodiment, the means for reducing or cancelling surrounding noise and/or playing a sound identical or similar to a sound generated during the use of a scuba diving regulator, is preferably connected to the pressure and/or flow rate sensor (d) of the ventilation tool (A), and the audio module (D) advantageously makes it possible to play the inspiratory and expiratory sounds in a way that is synchronized with the ventilation of the subject.

A particular system (Y) comprises an audio module (D) comprising an audio file reader (f) and a memory card (g), said memory card preferably comprising a first sound file for playing an inspiratory sound and a second sound file for playing an expiratory sound: the sensor(s) (d) is/are a pressure and/or flow rate sensor or sensors which delivers/deliver a signal; and the device (Z) comprises a processor or a microcontroller (e) which:

i) analyses the signal delivered by the pressure and/or flow rate sensor (d) by comparing the pressure level with at least two previously determined pressure thresholds, and ii) transmits a signal to the audio file reader (f) which triggers or stops the reading of the first or second sound file according to the inspiratory or expiratory nature of the phase of ventilation in which the subject is, by adapting, preferably automatically, the intensity of the sound volume as a function of the difference at the two previously determined thresholds, and preferably iii) records the signal(s) delivered by the sensor(s) (d) and/or transmitted to the audio file reader (f).

The device (A), the system (X) or the system (Y) may comprise, or be connected to, one or more additional sound files for playing one or more sounds at the moment of the inspiration and/or the expiration of the subject, or continuously during the respiratory cycle of the subject, and/or may comprise, or be connected to, one or more files forming a medium for a visual content and where applicable a medium or media for the sound associated with said visual content.

As indicated, the system (Y) comprising a ventilation device (A) may advantageously comprise a tool (B) for viewing a virtual reality content.

The tool (B) typically comprises at least one screen and a number of lenses. The display screen is typically miniature and can be a cathode ray tube screen (CRT), a liquid crystal display screen (LCD), a liquid crystal on silicon screen (LCoS) or a light-emitting diode screen (OLED). According to a particular embodiment, the tool comprises many micro-screens making it possible to increase the resolution and field of view.

The tool (B) is typically a display device comprising a small display screen facing one eye (monocular tool) or each eye (binocular tool).

When it is binocular, the tool (B) can display a different image in front of each eye. This makes it possible to display stereoscopic images, i.e. images that represent a reality in three dimensions ("3D"). Such a tool can be advantageously used to replicate a perception of the relief on the basis of two planar images. In a preferred embodiment, the tool (B) is a binocular tool allowing the user to perceive the depth (presence of two video inputs supplying a video signal to each eye: use of time-based multiplexing, side by side or top to bottom).

The tool (B) typically offers a field of view of 60° to 230°, preferably of 60° to 210°, for example of 60° to 170°, and a binocular overlap preferably between 50° and 180°. It typically offers a resolution of 4K per eye preferably.

Preferably, the eye (B) is adapted to its user and is adjusted to take into account its pupillary distance in particular.

The tool (B) makes it possible to display images of the real world, computer-generated images or a combination of images of the real world and computer-generated images. The combination of a view of the real world and a computer-generated image can be done by projecting the computer-generated image onto a partially transparent mirror which also allows the real world to be seen by transparency. This method is also called "optical see-through". The combination of the two worlds can also be done electronically by recording the real world by means of a digital camera and mixing computer-generated images into it. This method is also called "Video See-Through".

The tool (B) can preferably be selected from among a headset, a visor, a mask and a pair of (virtual reality) spectacles, or be integrated into, for example, a headset, a visor, a mask and a pair of (virtual reality) spectacles. The tool (B) can also be embodied on a smartphone. The tool (B) is typically a display device worn on the head or in a headset.

Advantageously, the system (X), the virtual reality system (Y) and/or the tool (B) comprises an integrated operating system for playing a virtual reality content (the tool (B) is in this case classified as a "smart" tool), or is connected to a tool (C) for playing a virtual reality content.

The tool (C) for playing a virtual reality content is preferably selected from among a computer, a memory card, a games console, a smartphone and the Internet.

When it is present within the system (X) or the system (Y) and/or the tool (B), the integrated system may comprise a file system allowing the applications to read and write files to a non-volatile memory area of the physical system. In another embodiment, the system (X), the system (Y) and/or the tool (B) comprises a networked sensor (preferably a wireless sensor allowing exchanges of data, for example via infrared) capable of retrieving information and transmitting it over the network.

The virtual reality content is a set of images/views of the real world, computer-generated images or a combination of images/views of the real world and computer-generated images. The virtual reality content is preferably a film, for example the film of an experience of the subject moving through space, preferably an experience of the user of the system (Y) himself, whether the space is aquatic, terrestrial, aerial or spatial. It can for example be a film of a scuba dive, a flight (with or without a means of transport such as an airplane or a hot air balloon for example), a voyage and/or a visit to a site of interest, for example a visit made on foot or using a means of transport.

The system (X) or the virtual reality system (Y) and/or the tool (B) can be provided with a user interface.

The system (X) or the system (Y) according to the invention can also comprise a means (H) for modulating the temperature of all or part of the scalp of the subject, typically by means of a liquid or a gas, where applicable circulating, and/or a means (I) for delivering or generating electrical impulses across all or part of the scalp of the subject.

The means (H) and (I) can advantageously be used to stimulate the subject by acting via his scalp and make it possible to replicate a sensory experience. Such tools allow the subject to more easily attain a state of relaxation and therefore facilitate the use of the device and the observance of a protocol as described in this text, for example a therapeutic protocol (for the direct benefit of the patient subject).

The means (H) and/or (I) are configured in such a way as to be disposed over all or part of the scalp of a subject. The means (H) and/or (I) can thus take the form of a cap, typically as regards the means (I) in the form of an electrode mask.

The means (H) typically makes it possible to replicate hot/cold sensations. It comprises a chamber or a tubular network making it possible, once filled with a liquid or a gas, where applicable circulating, to modulate the surface temperature of all or part of the scalp of the subject. Contact with a cold enough liquid, or the circulation of such a liquid, causes the vasoconstriction of all or part of the cerebral vessels of the subject. This effect can be obtained at temperatures between 10° C. and 25° C., preferably between 15° C. and 22° C. Conversely, contact with a hot enough liquid, or the circulation of such a liquid, causes the vasodilation of all or part of the cerebral vessels of the subject. This effect can be obtained at temperatures between 26° C. and 38° C., preferably between 28° C. and 35° C.

The means (I) typically makes it possible to deliver or generate electrical impulses across all or part of the scalp of the subject. It advantageously comprises a wired network of electrodes, said electrodes being preferably movable. The means (I) can for example by a headcap with tethers or a cap taking the form of a net, said cap being preferably provided with electrodes integrated into said tethers or to said net.

The thermal stimulation and/or electrical stimulation are preferably controllable, and can, according to a preferred embodiment, be engaged, modulated or stopped directly by the user. For this purpose, the system (X) advantageously comprises one or more temperature and/or electrical activity sensors (d) disposed inside a system (X), advantageously taking the form of a cap, in such a way as to be in contact with the scalp of the user subject. A processor or microcontroller (e) makes it possible to i) analyze the signal received by the sensor(s) (d), typically by comparing the value of the received signal to a value or to an interval of reference values, and following the analysis, ii) transmit a signal to a receiver, for example to a module (H) or (I) as described in this text triggering, modulating or stopping a thermal or electrical stimulation, for example as a function of previously determined reference threshold values of temperature/electrical activity, by comparison with the detected value or with said reference values.

As described in this text, in connection for example with the audio module (D), the combination of the device (A) with one or more other means described in this text, or all of these, chosen from among a tool (B), an audio module (D), a means (H) for modulating the temperature of all or part of the scalp of the subject and a means (I) for delivering or generating electrical impulses across all or part of the scalp of the subject promotes the establishment of a state of heart coherence in the user subject. Unconsciously, the latter will adjust his breathing/his respiratory cycle, i.e. one the one hand his inspiration and on the other hand his expiration, to the environment he perceives. The combination of several means therefore facilitates the use of said device, or more generally of the virtual reality system (Y), and therefore the observance of a protocol as described in this text, for example a therapeutic protocol (for the direct benefit of the patient subject).

The device (A), the system (Z), the system (X) or the virtual reality system (Y) as described by the inventors preferably comprises an integrated electrical power source or a means of connection (wired or wireless) to an electrical power source (electrical grid, cell, battery etc.), for example. In a particular embodiment, the electrical power source is a power source (m) internal to the system (Z) or an external power source (J) connected to said system (Z).

The device (A), the system (Z) or the system (X) as described by the inventors operates according to a preferred embodiment by transmission of the signals via a wireless system, for example WiFi or Bluetooth.

One or the other of the virtual reality systems according to the invention as described by the inventors is advantageously usable to allow the user subject to reach a state of heart coherence or, in other words, to allow him to increase his heart rate variability. It is therefore for example usable for a therapeutic purpose as described in this text.

The inventors also describe a kit comprising at least one device (A), a system (X) or a system (Y) as described by the inventors, and a virtual reality content attached to a computer medium, for example to a memory card or a USB stick, preferably to a memory card.

In a particular embodiment, the invention pertains to an item of ventilation equipment, for example an item of diving ventilation equipment, in particular a diving regulator, comprising a device (A), a system (X) or a system (Y) as described in this text.

The invention also relates to the use of a tool as described by the inventors in this text, typically a device (A), a system (X), a system (Y) or a kit, to simulate, in a preventive or therapeutic framework/context, an experience, typically a movement of the user through space, whether the space is aquatic, terrestrial, aerial or spatial, for example a scuba dive, a flight (with or without a means of transport such as an airplane or a hot air balloon for example), a voyage and/or visit to a site of interest, for example on foot or using a means of transport, the objective being to allow the user subject to reach, or maintain, the desired state of equilibrium, i.e. the state of heart coherence, or to simulate, in an entertainment or relaxation framework/context, an experience, typically a movement of the user through space, whether the space is aquatic, terrestrial, aerial or spatial, for example a scuba dive, a flight (with or without a means of transport such as an airplane or a hot air balloon for example), a voyage and/or visit to a site of interest, for example on foot or using a means of transport, or the virtual world of an electronic game.

In the context of the present invention, the subject is a mammal, preferably a human being regardless of age or sex. The subject can be a healthy subject (typically in the entertainment or relaxation framework/context described above) or a subject suffering from a disease or disorder related to stress or anxiety as described in this text, or from a symptom of said disease or of said disorder, or else a subject suffering from migraine and where applicable associated aura(s) (typically in the preventive or therapeutic framework/context described above). The subject is typically a human user of the ventilation device (A) as described for the first time by the inventors in this text.

The inventors have specifically shown beneficial effects on the health of users of a tool according to the invention as described in this text by the inventors, in particular beneficial effects on the following physiological parameters of the subject: respiratory frequency, respiratory volume (tidal volume), expiratory capnia (amount of $CO_2$ expired), cardiac frequency (or heart rate), heart coherence, sympathovagal balance and the electrical activity of an organ.

Advantageously and preferably, beneficial effects are observed:

- immediately, simultaneously for the following physiological parameters (Example 1): respiratory frequency, rate of expiratory $CO_2$, tidal volume and cardiac frequency;
- in the medium term (beyond several hours, for example a week, in repeated use) and long term (beyond one month in repeated use, preferably at least two months, three months, four months, five months or six months), simultaneously for the following physiological parameters: heart coherence and sympatho-vagal balance.

The inventors were also able to demonstrate beneficial effects on subjects who used the described tools in the areas of better recovery, quality of sleep, improvement in concentration and memory, decrease in attention deficit and hyperactivity disorders, improvement of mood, better resistance to stress, decrease in anxiety and perceived stress, better pain tolerance, and improvement of inflammatory symptoms.

In a particular embodiment, the subject suffers from a disease or a disorder related to stress or anxiety, or from a symptom of said disease or of said disorder.

The disease or a disorder related to stress or anxiety can for example be selected from among "burn-out", Post-Traumatic Stress Disorder ("PTSD"), depression, panic attacks, or attention deficit disorder with or without hyperactivity (ADHD). The inventors were also able to demonstrate beneficial effects on subjects who used the described tools in the areas of reduction of symptoms of sympatho-vagal balance anomalies (shown via detection of heart rate variability), symptoms of burn-out (detected by reduction of Maslach Burnout Inventory scores), post-traumatic stress (detected by reduction of questionnaire PCL-5 scores). In general, the inventors were able to show beneficial effects on the perceived stress level (evaluated by the Cohen PSS scale), and stress management, and the level of resilience or mindfulness (evaluated by the Wallach FMI scale (2006)).

A method for preventing or treating, in a subject, a disease or a disorder related to stress or anxiety or a symptom of said disease or of said disorder, and/or migraine, is also described by the inventors.

This prevention or treatment method according to the invention comprises the use by the subject of a tool as described by the inventors in this text, typically of a device (A), a system (X), a system (Y), a kit, an item of diving ventilation equipment, a diving regulator or a diving regulator simulator, preferably a system (Y), to prevent or treat the disease, disorder and/or migraine in the subject, alone or in combination with one or more gases and/or one or more active molecules used in the prevention and treatment of the disease, disorder, symptom of said disease or disorder and/or migraine. In a particular embodiment, this method is combined with the implementation by the subject using a device as described in this text of the diving protocol "BATHYSMED" ("BTY").

A particular protocol for using a tool as described by the inventors in this text, typically a device (A), a system (X), a system (Y), a kit, an item of diving ventilation equipment, a diving regulator or a diving regulator simulator, preferably a system (Y), comprises the following steps:

- A step of sophrology/mental preparation of the user of the tool (for example of a duration of approximately 2/3 minutes), and
- The projection to the user of a film simulating the different steps of a scuba dive.

In a particular embodiment, the step of projecting the protocol described above comprises in order:

- Where applicable, the entry of the diving user into the water (for example of a duration of approximately 1 minute),
- A phase of the diving user descending to a seabed (for example of a duration of approximately 1 minute),
- A phase of the diving user pausing on the sea bed (for example of a duration of approximately 1 to 2 minutes),
- The performing by the diving user of a series of exercises (for example of a duration of approximately 5 to 10 minutes) aiming for example to make the user aware of his 5 senses, and/or all or part of his body, by way of a sophrology exercise or exercises, for example one or more sophrology exercises 1 to 4 of the "BTY" protocol described in the experimental part,
- Where applicable a phase of the diving user taking a quiet walk around (for example of a duration of approximately 4 to 5 minutes),
- Where applicable a phase of the diving user pausing on the sea bed (for example of a duration of approximately 1 minute), and
- A phase of the diving user reascending to the surface (for example of a duration of approximately 1 minute).

In a particular embodiment where the disease or disorder related to stress or anxiety is "burn-out", the active molecule(s) used, or the gas(es), may be selected from among a rare gas, for example argon and/or xenon, and a mixture of one or more rare gases with oxygen and/or helium.

In a particular embodiment where the disease or disorder related to stress or anxiety is post-traumatic stress disorder or syndrome ("PTSD"), the active molecule(s) conventionally used may be selected from among a rare gas, for example argon and/or xenon, and a mixture of one or more rare gases with oxygen and/or helium.

In a particular embodiment where the disease or disorder related to stress or anxiety is depression, the active molecule (s) conventionally used may be selected from among a rare gas, for example argon and/or xenon, and a mixture of one or more rare gases with oxygen and/or helium.

In a particular embodiment where the disease or disorder related to stress or anxiety is panic attacks, the active molecule(s) conventionally used may be selected from among a rare gas, for example argon and/or xenon, and a mixture of one or more rare gases with oxygen and/or helium.

In a particular embodiment where the disease or disorder related to stress or anxiety is attention deficit disorder with or without hyperactivity (ADHD), the active molecule(s) conventionally used may be selected from among a rare gas, for example argon and/or xenon, and a mixture of one or more rare gases with oxygen and/or helium.

In the Gaming world, the desire to simulate immersion in simulated environments is constant. The script of the Steven Spielberg film "Ready Player One" is the perfect expression of this with an attempted full immersion of the hero in a virtual world. The claimed invention (typically the device (A), the system (X), the system (Y) or the kit) makes it possible to access the virtual world proposed by the script of the game while placing the user subject in a state of sensory isolation with regard to stimulations coming from his direct environment and, contrariwise, of greater sensitivity/receptivity to the stimulations induced by the game.

The invention has been described for several embodiments in order to introduce the general principle. However, those skilled in the art will be able to adapt the invention to other embodiments without departing from the essential features described in this text. The invention thus comprises all means constituting technical equivalents of the described means, and their various combinations. The described embodiments must therefore be considered in all respects as solely illustrative and non-restrictive.

KEY TO THE FIGURES

FIG. 1: Section of the ventilation device (A) and ventilatory flow.

FIG. 1 shows a section of a ventilation device (A) according to an embodiment of the invention. The arrows symbolize the movement of the gas mixture (air or other) through the device and through its environment. In this embodiment, the double-line arrows show the path of the gas mixture in the inspiratory phase. The gas mixture passes through the one-way inspiratory valve (1) then crosses the ventilation chamber (2) and the mouthpiece (3) in order to be inhaled (inspired) by the user. The arrows in dotted bold lines show the path of the gas mixture in the expiratory phase. The gas mixture passes through the mouthpiece (3), then crosses the ventilation chamber (2) and passes through the one-way expiratory valve (4) to arrive in the outside environment.

Figure 2:
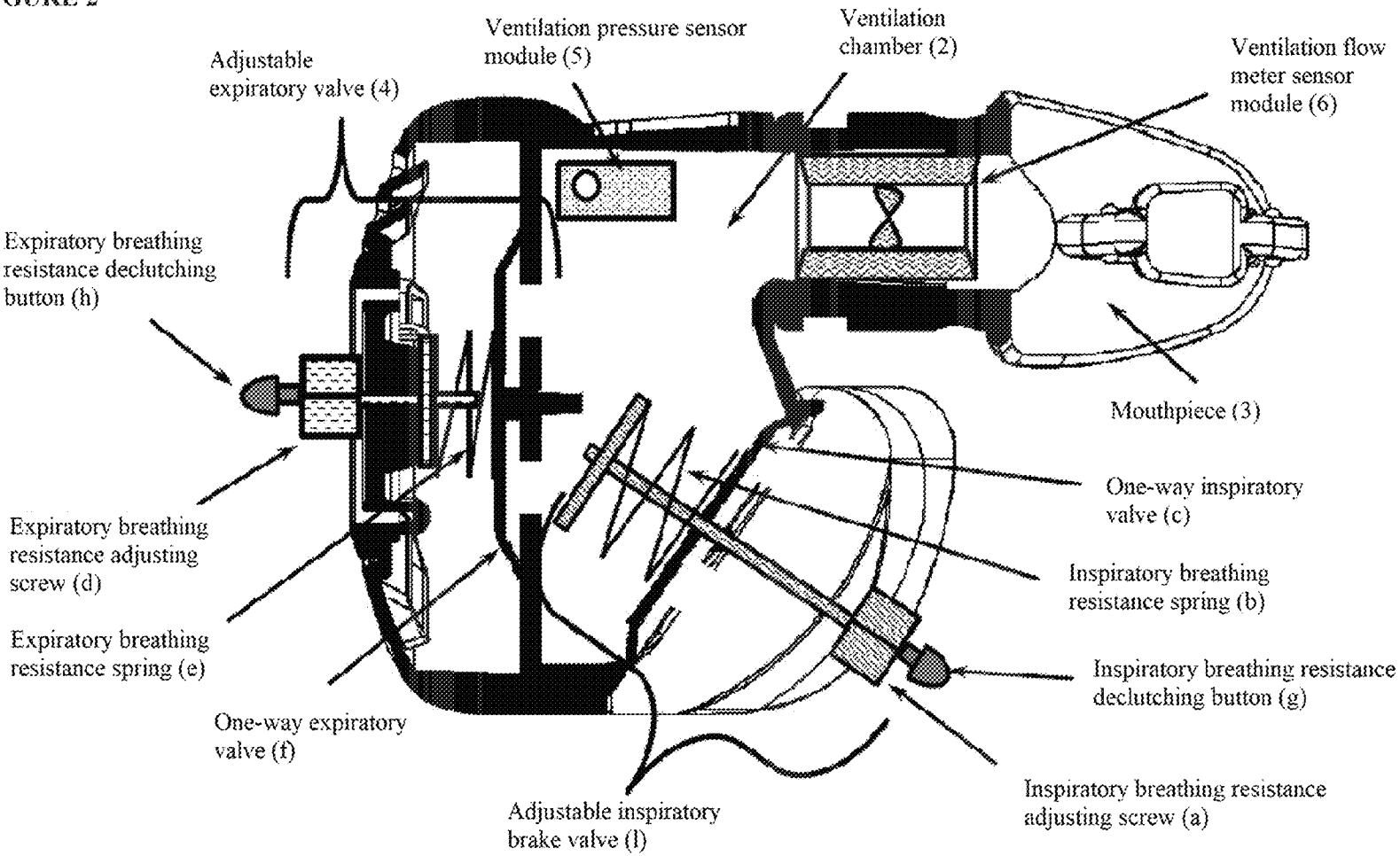

FIG. 2: Section of a ventilation device (A) including valves with adjustable inspiratory and expiratory breathing resistance and independent means for declutching from the ventilation breathing resistance.

FIG. 2 shows a section of a ventilation device (A) according to an embodiment of the invention. In this embodiment, the inspiratory brake valve (1) includes a screw for adjusting/taring the inspiratory breathing resistance (a), an inspiratory breathing resistance spring (b) and a one-way inspiratory valve (c). The subject can work the taring screw (a) to adjust the resistance of the breathing resistance spring (b) which restricts the inspiratory valve (c). The expiratory brake valve (4) includes a screw for adjusting/taring the expiratory breathing resistance (d), an expiratory breathing resistance spring (e) and a one-way expiratory valve (f). The subject can work the taring screw (d) to adjust the resistance of the breathing resistance spring (e) which restricts the expiratory valve (f).

During the inspiration phase, the gas mixture located in the ventilation chamber (2) passes into the oral or oronasal endpiece (3) and generates a depressurization in the ventilation chamber (2); when the depressurization value reaches the tare value of the inspiratory breathing resistance spring (b) the inspiratory valve (c) opens and allows the gas mixture to pass through the chamber and the mouthpiece to supply the user. The one-way expiratory valve (4) remains closed, since it does not function during a depressurization in the chamber (2).

During the expiration phase, the gas mixture expired by the user passes through the mouthpiece (3) and the chamber (2): the pressure rises therein. When the pressure value reaches the tare value of the expiratory breathing resistance spring (c), the expiratory valve (f) opens and lets the gas mixture pass from the chamber to the outside environment of the ventilation device (A). The one-way inspiratory valve (1) remains closed in this phase, since it does not function with a positive pressure in the chamber (2).

The buttons for declutching the inspiratory and expiratory breathing resistance, (g) and (h) respectively, allow the user, when he exerts pressure on them, to independently release the inspiratory or/and expiratory brakes by releasing the compressive stresses on the springs.

The ventilation pressure sensor (5) and ventilation flow meter sensor (6) modules installed in the chamber (2) are used to communicate to the system (z) the physiological ventilation data of the user.

Figure 3:
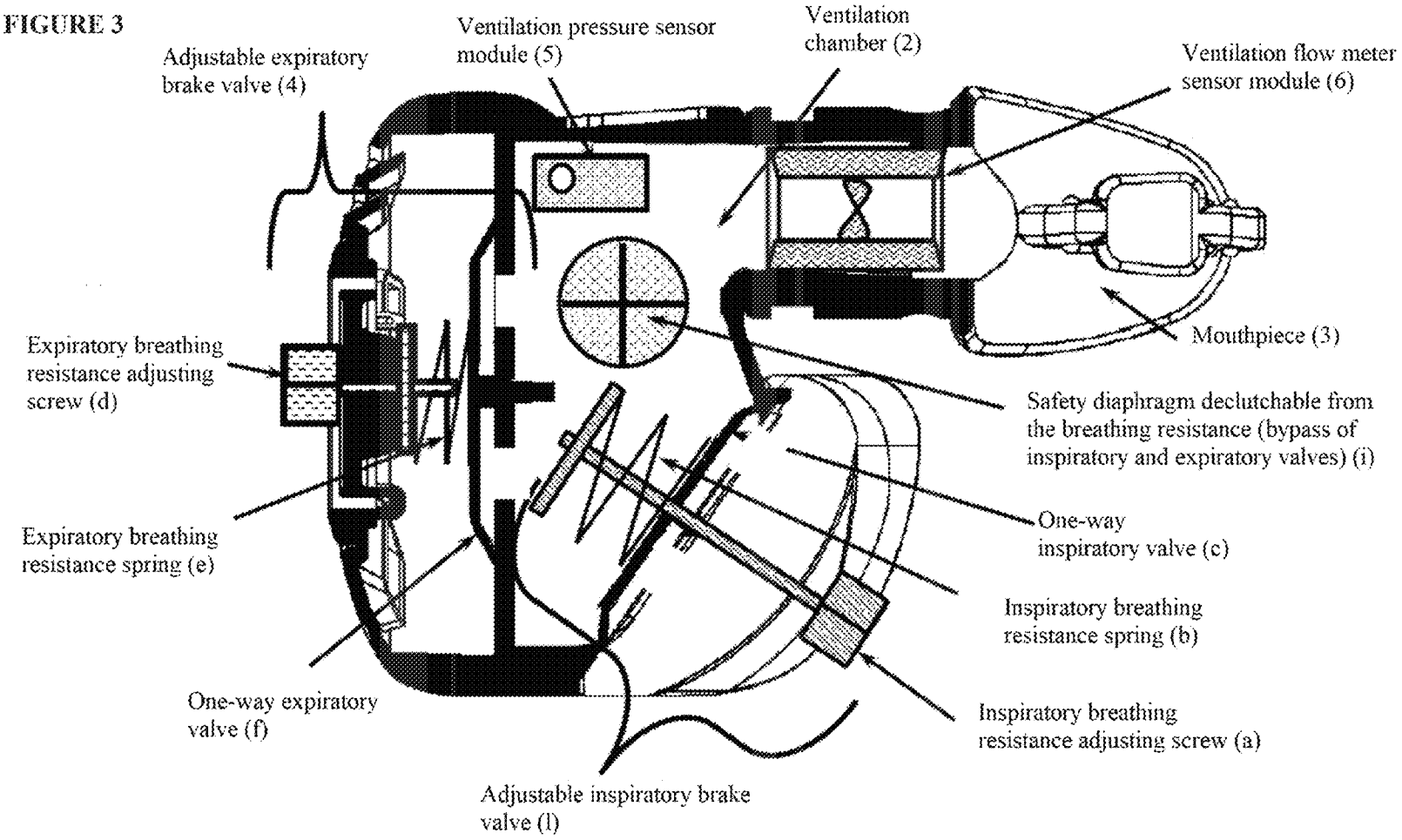

FIG. 3: Section of a ventilation device (A) including valves with adjustable inspiratory and expiratory breathing resistance and a bypass diaphragm drivable by the user.

FIG. 3 shows a section of a ventilation device (A) according to an embodiment of the invention. In this embodiment, the inspiratory brake valve (1) includes a screw for adjusting/taring the inspiratory breathing resistance (a), an inspiratory breathing resistance spring (b) and a one-way inspiratory valve (c). The subject can work the taring screw (a) to adjust the resistance of the breathing resistance spring (b) which restricts the inspiratory valve (c). The expiratory brake valve (4) includes an expiratory breathing resistance adjusting screw (d), an expiratory breathing resistance spring (c) and a one-way expiratory valve (f). The subject can work the taring screw (d) to adjust the resistance of the breathing resistance spring (e) which restricts the expiratory valve (f).

During the inspiration phase, the gas mixture located in the ventilation chamber (2) passes into the oral or oronasal endpiece (3) and generates a depressurization in the ventilation chamber (2). When the depressurization reaches the tare value of the inspiratory breathing resistance spring (b) the inspiratory valve (c) opens and allows the gas mixture to pass through the chamber and the mouthpiece to supply the user. The one-way expiratory valve (4) remains closed, since it does not function during a depressurization in the chamber (2).

During the expiration phase, the gas mixture expired by the user passes through the mouthpiece (3) and the chamber (2). The pressure rises therein. When the pressure value reaches the tare value of the expiratory breathing resistance spring (e), the expiratory valve (f) opens and lets the gas mixture pass from the chamber to the outside of the ventilation device (A). The one-way inspiratory valve (1) remains closed in this phase, since it does not function with a positive pressure in the chamber (2).

The chamber (2) may also comprise a declutching diaphragm (i) for disabling and bypassing the brake valves (1 and 4). This declutching diaphragm (i) acts as a safety against the level of solid obstruction of the system, which requires a complete absence of obstacles to inspiration and/or to expiration.

The ventilation pressure sensor (5) and ventilation flow rate sensor (6) modules installed in the chamber (2) are used to communicate to the system (Z) the physiological ventilation data of the user.

Figure 4:
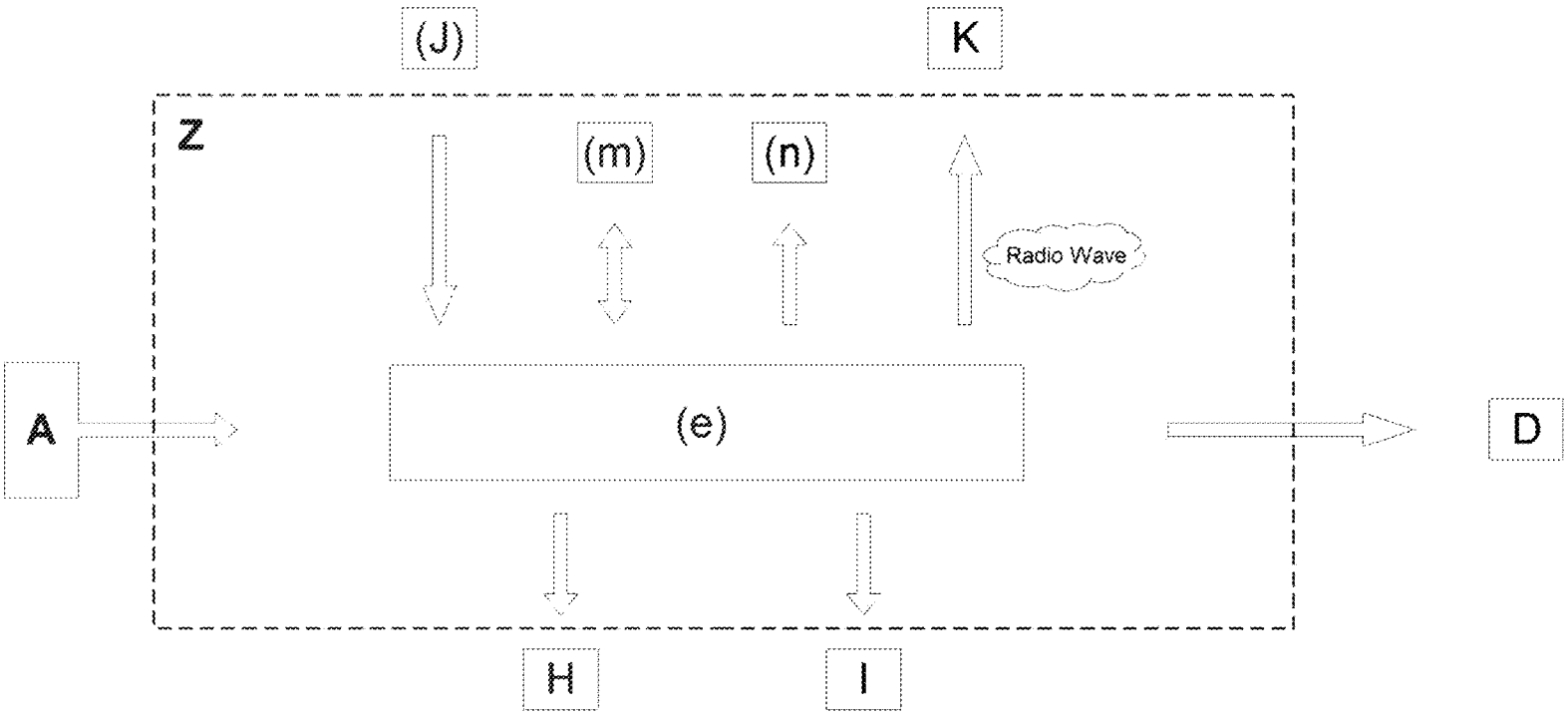

FIG. 4: Schematic representation of an example of a (control) system Z

FIG. 4 is a schematic representation of an example of a (control) system Z. The (control) system Z represented comprises a processor (e) receiving the signals delivered by the sensors of the ventilation device A. This processor (e) drives the audio module D, the module H allowing the thermal adjustment of the scalp and the module I for delivering electrical impulses to the scalp. The processor (e) also records the data received from the sensors of the ventilation device A on a recording module (n) and preferably has means of wireless communication to a recording PC (K). The system Z is powered by a battery (m) rechargeable when the system Z is connected to an external power supply (J). Moreover, J can be the programming PC used to install the software of the control system Z. H and/or I are configured in such a way as to be disposed over all or part of the scalp of a subject. H and/or I can take the form of a cap, typically as regards I in the form of an electrode mask. H typically makes it possible to replicate hot/cold sensations and comprises a chamber or a tubular network making it possible, once filled with a liquid or a gas, where applicable circulating, to modulate the surface temperature of all or part of the scalp of the subject.

Figure 5:
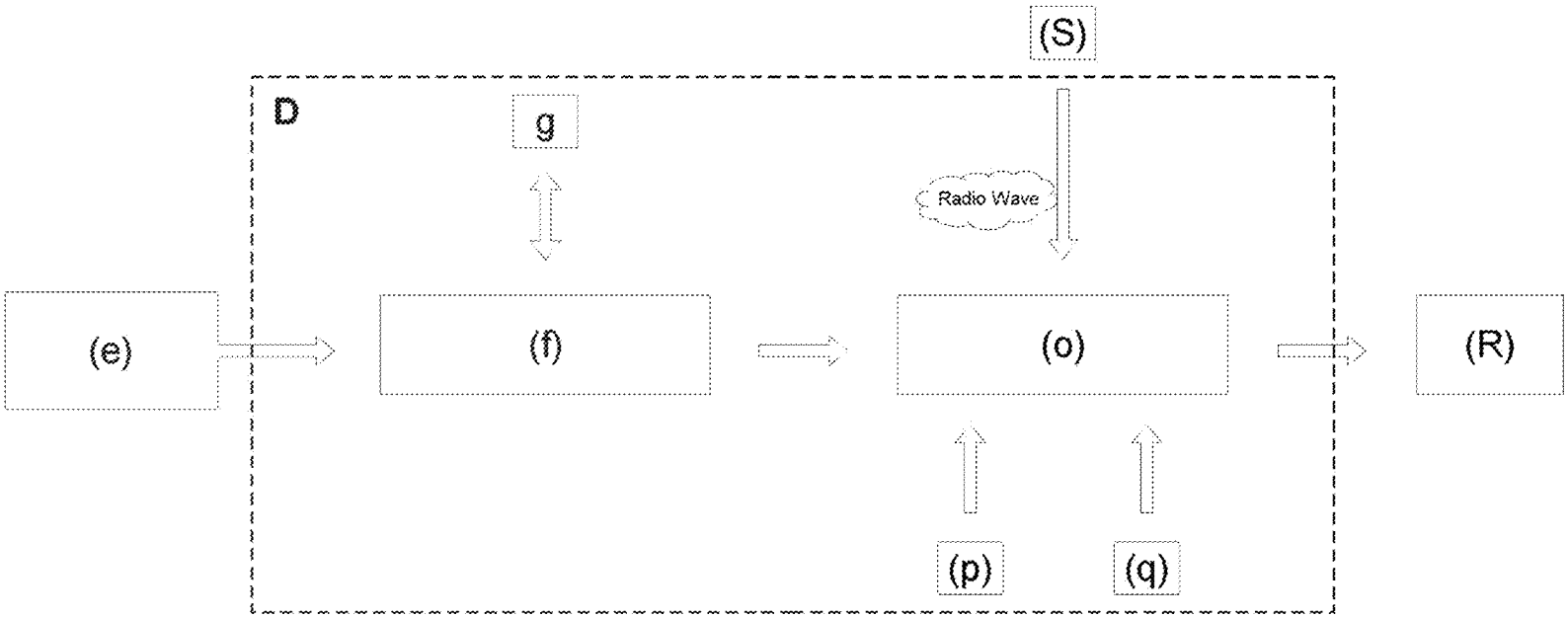

FIG. 5: Schematic representation of an example of an audio module D

FIG. 5 is a schematic representation of an example of an audio module D. The audio module D represented comprises a digital input intended to receive orders to read a sound file or files and orders to adjust the sound level, from the processor (e) of the control system Z. The audio file reader (f) executes the orders of the processor (e) of the (control) system Z and compiles a primary audio stream by reading the sound files recorded on the memory card (g). The mixer/amplifier (o) mixes the primary audio stream coming from the audio file reader (f) with a secondary audio stream coming from the secondary audio source(S). The sound levels of each stream in the mixed audio stream are adjustable via the potentiometers (p) and (q). The mixed audio stream is sent to the audio headset (R).

Figure 6:
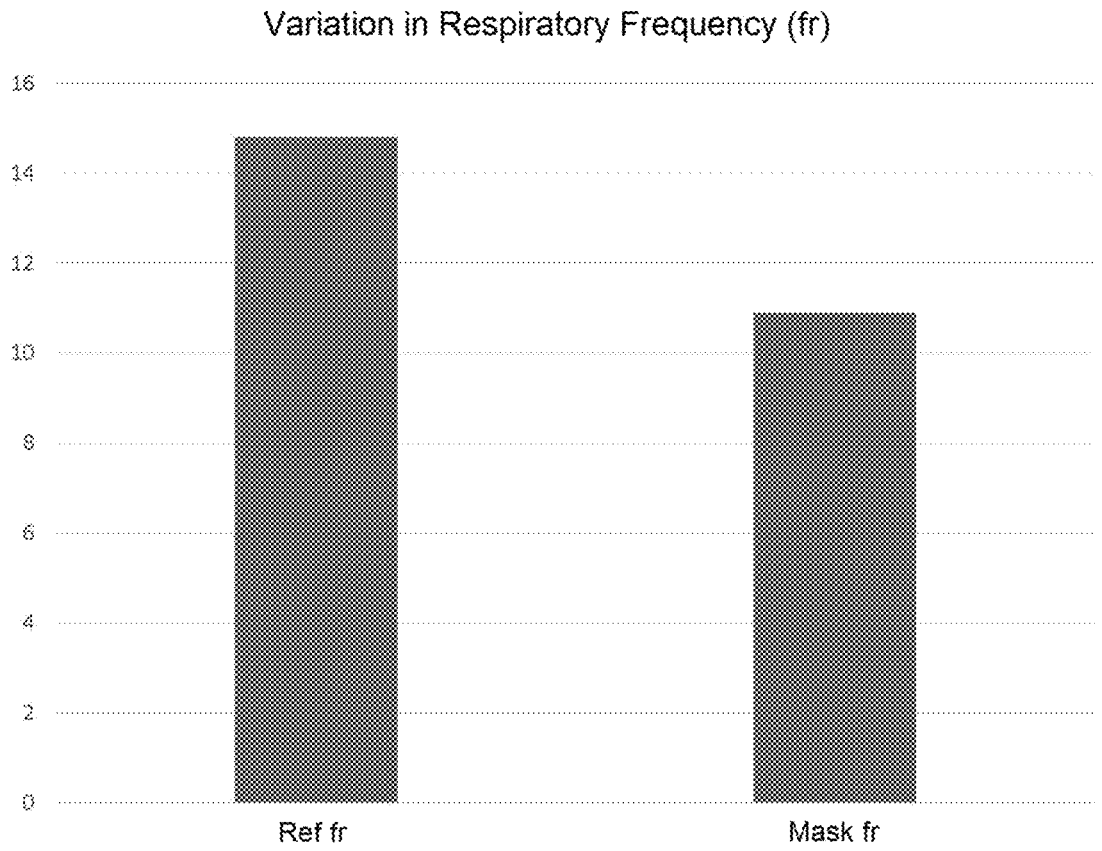

FIG. 6: Graph showing the variation in test subjects of the respiratory frequency (per minute) allowed by the device (A) according to the invention.

Figure 7:
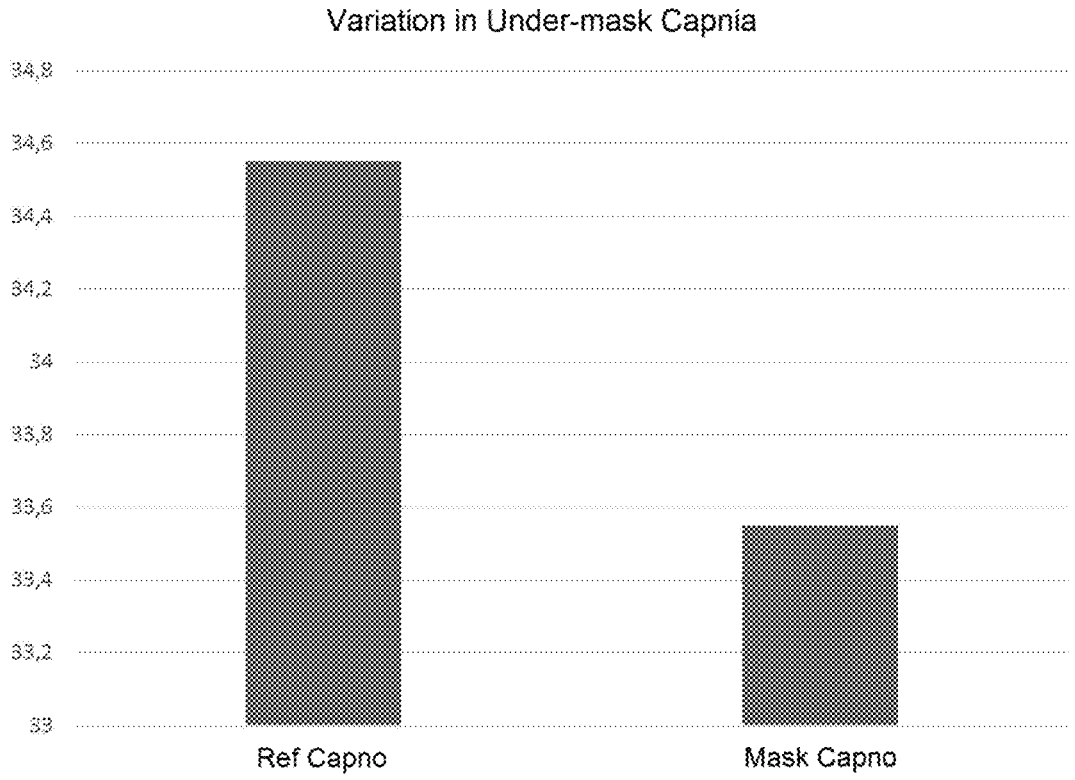

FIG. 7: Graph showing the variation in test subjects of the capnia (in mm Hg) allowed by the device (A) according to the invention.

Figure 8:
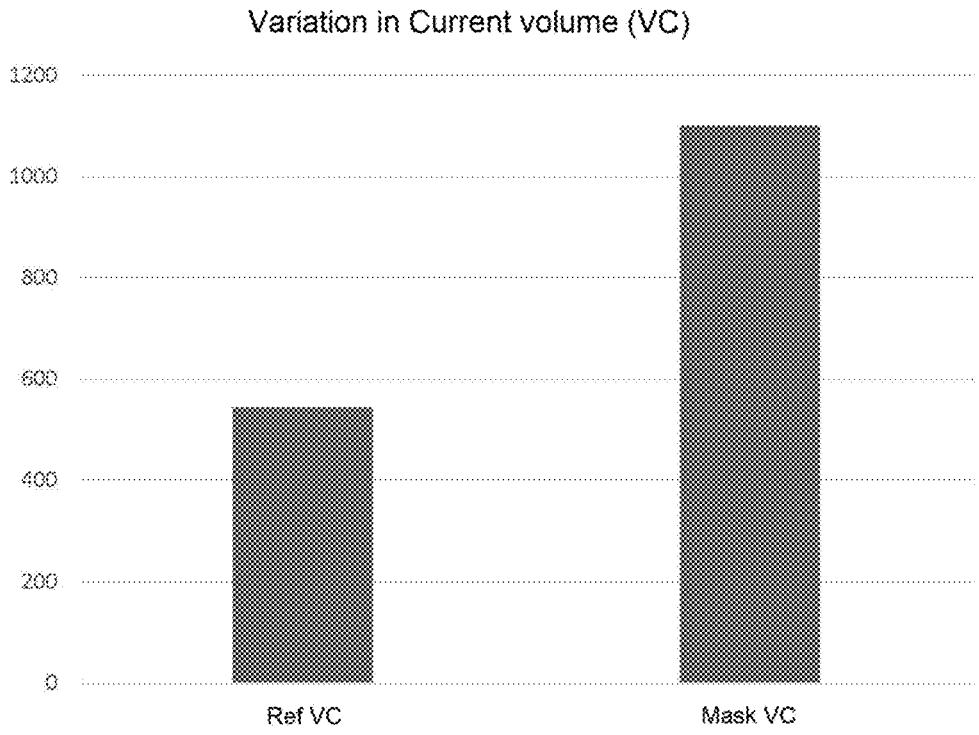

FIG. 8: Graph showing the variation in test subjects of the tidal volume (in milliliters) allowed by the device (A) according to the invention.

Figure 9:
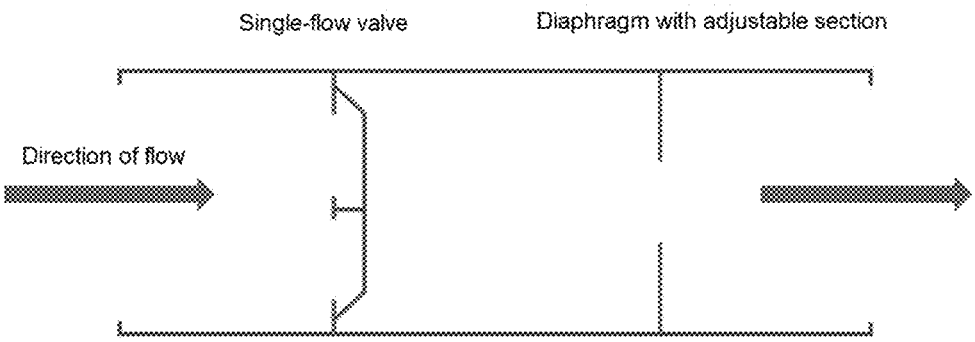
Figure 9:
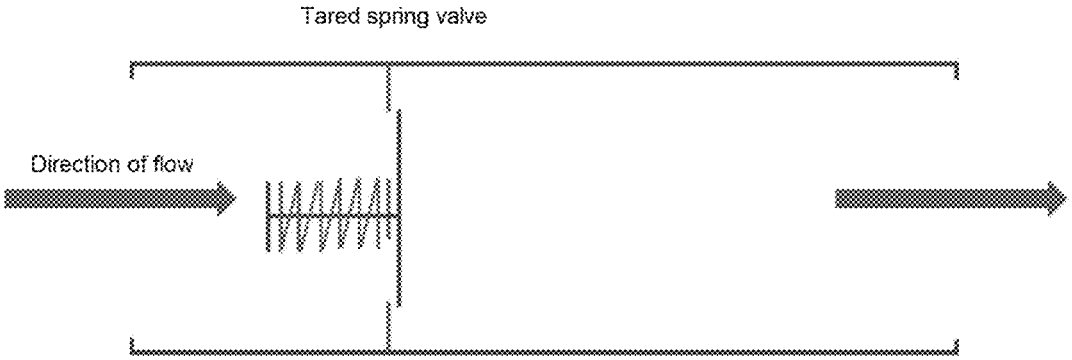
Figure 9:
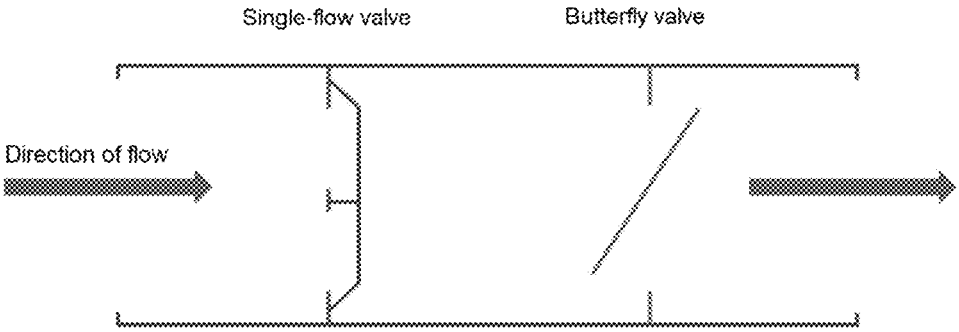

FIG. 9: (A) single-flow valve combined with an adjustable diaphragm: the single-flow valve makes it possible to guide the direction of flow of the gas. The variation of the diaphragm makes it possible to adjust the respiratory pressure (effort): (B) valve tared to an opening pressure: The valve makes it possible to guide the direction of flow of the gas. The taring of the spring makes it possible to adjust the respiratory pressure (effort): (C) butterfly valve: The single-flow valve makes it possible to guide the direction of flow of the gas. The variation of the angle of the butterfly tap makes it possible to adjust the respiratory pressure (effort).

Figure 10:
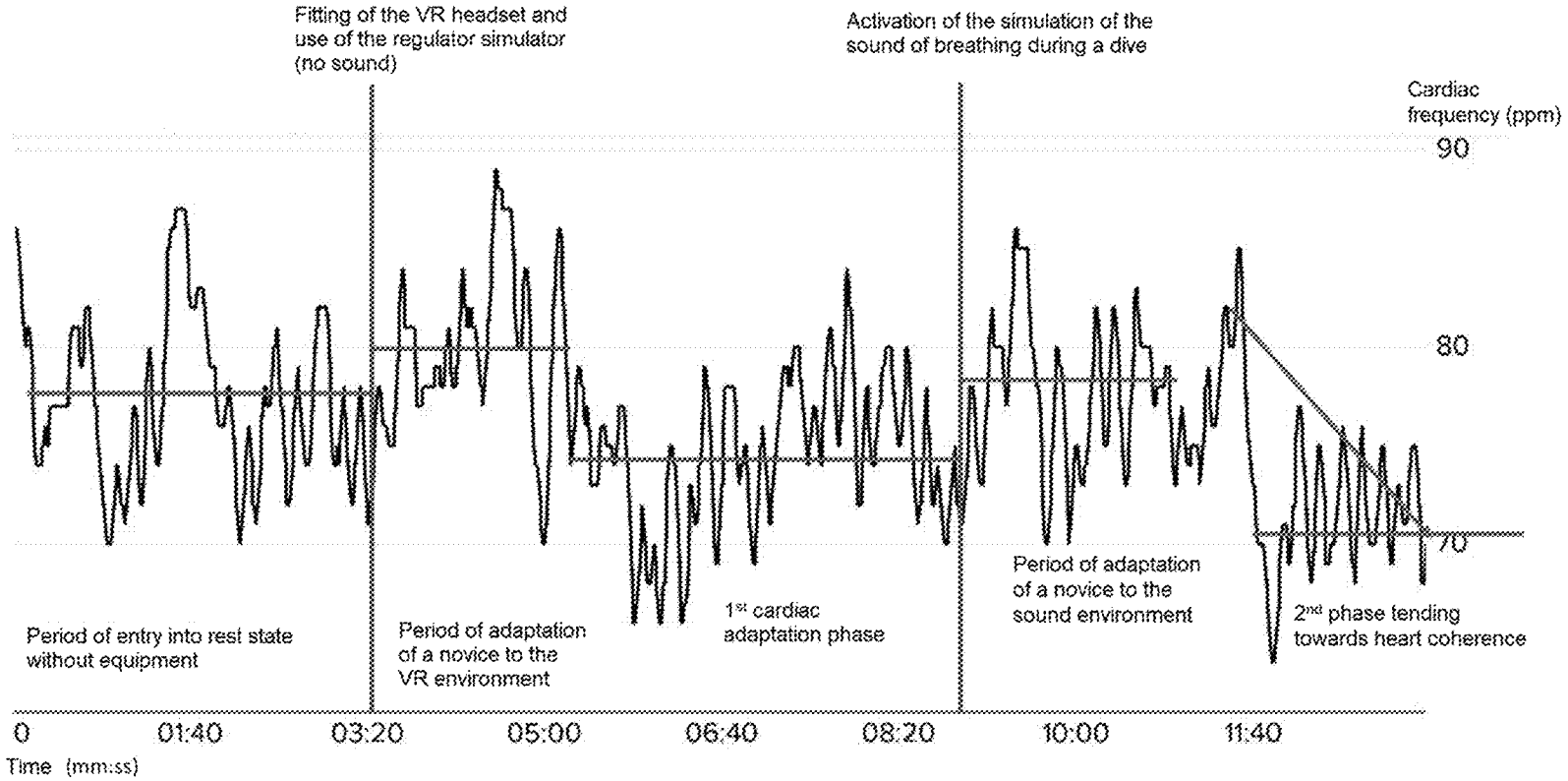

FIG. 10: Graphic showing the variation in cardiac frequency (heart rate) in a subject who has never undergone a virtual reality experience when he uses a system (Y) according to the invention.

The protocol followed comprises the following steps:

1) subject at rest [not equipped with the system (Y)]: the phase lasts 3 minutes, the time it takes to allow the subject to return to his resting heart rate;
2) the subject uses the system (Y) according to the invention for approximately 5 minutes: he views a film using a tool (B), breathes through the mouthpiece of the device (A) but has no sound feedback. After a first phase of adapting his heart rate becomes stabilized at a level lower than his resting heart rate;
3) the audio module (D) located in the system (Y) is engaged. This step lasts approximately 5 minutes: after an adaptation phase, the heart rate of the subject decreases still further to reach the lowest level of the experiment, thus allowing the subject to tend toward a state of heart coherence.

Figure 11:
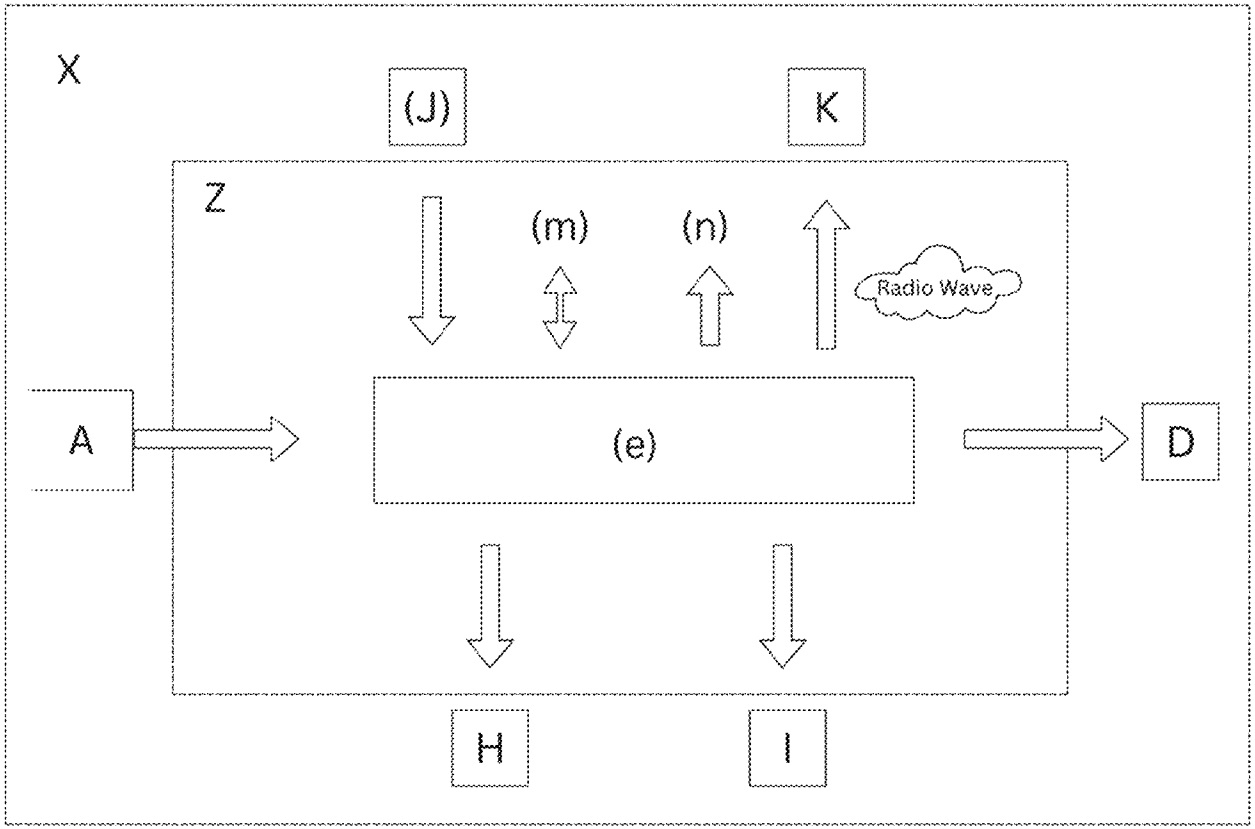

FIG. 11: Schematic Representation of an Example of a System (X)

FIG. 11 is a schematic representation of an example of a system (X). In this example, the system comprises the ventilation device (A) which contains a flow rate sensor (d) and a device (Z) for receiving, storing, processing and/or transmitting data acquired by the ventilation device (A). An example of the device (Z) comprises a processor (e) receiving the signals delivered by the sensors of the ventilation device A. This processor (e) drives the audio module D, the module H allowing the thermal adjustment of the scalp and the module I for delivering electrical impulses to the scalp. The processor (e) also records the data received from the sensors of the ventilation device A on a recording module (n) and preferably has means of wireless communication to a recording PC (K). The device (Z) is powered by a battery (m) rechargeable when connected to an external power supply (J). (J) can be the programming PC used to install software.

Figure 12:
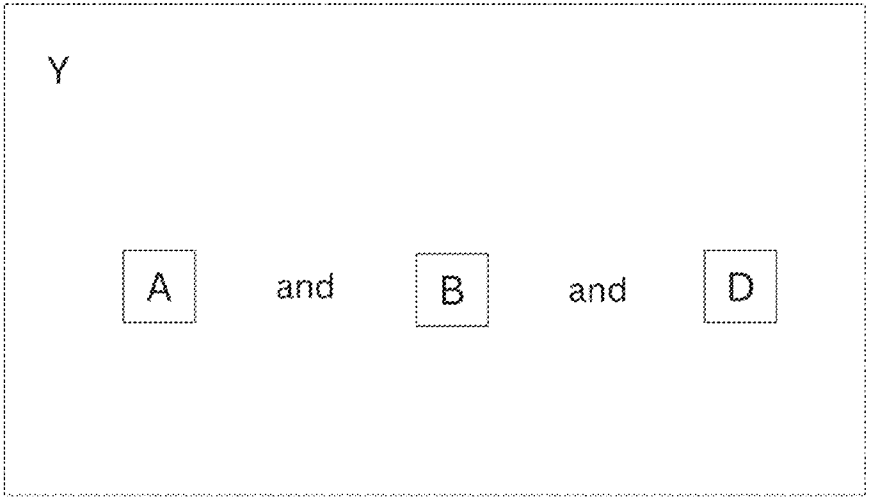

FIG. 12: Schematic representation of an Example of System (Y)

FIG. 12 is a schematic representation of an example of a system (Y). In this example, the system (Y) comprises a ventilation device (A), a tool (B) for viewing virtual reality content, virtual reality content (C), and an audio module (D) for listening to a virtual reality content. The tool (B) for viewing virtual reality content (C) typically comprises a screen and lenses. In one example, the tool (B) comprises an integrated operating system or is connected to a tool for playing virtual reality content (C).

Experimental Part

"BATHYSMED" ("BTY") protocol

The Bathysmed protocol is based on the combination of:

Sessions of mental preparation, meditation, sophrology and psychoeducation.

Diving theory classes.

Non-narcotic scuba diving sessions incorporating sophrology, relaxation and meditation exercises.

These exercises are explained beforehand and rehearsed on land.

Diving Theory

In France, the practice of diving is subject to compliance with the "sports code". To be able to exceed a depth of 6 meters, the subject must acquire a certain amount of theoretical knowledge about the hyperbaric environment to prevent the risk of diving accidents. During the protocol, this theoretical knowledge has been taught and validated by an MCQ.

Psychoeducation

This covered the psychophysiological aspects of PTSD (origins, symptoms and reactions), so that the patient could better understand his reactions and their functions. He was thus able to develop a feeling of control and consequently reduce his anxiety.

In-Class Introduction to BTY Diving Exercises and Sophrology, Relaxation and Meditation Sessions In most meditative practice, the session is conducted verbally by a guide. In sophrology, the Terpnos Logos concept involves a verbal action and denotes the way in which the sophrologist addresses the sophrology students. The impossibility of communicating verbally underwater meant that a thorough understanding was required before the start of the diving exercises. The protocol consequently made provision for teaching the method via demonstration videos, followed by meditation training which was then replicated during the dive.

The sophrology, relaxation and meditation session followed the following plan:

1. Know how to breathe appropriately
2. Know how to use one's breath to relax
3. Know how to use one's breath to reinforce one's energy and motivation
4. Learn to visualize something positive
5. Learn to visualize a future project
6. Learn to draw on one's personal capabilities
7. Prepare for life after the course constructively
8. Identify one's personal values The BTY Dive This had the aim of stimulating the psychology and physical body using specific exercises done in immersion. The dives were split into 3 periods. The 4 first dives were focused on feedback on the present moment, the development of the reappropriation of bodily sensations and the reactivation of concentration. The 5 to 8 dives, focused on the contemplative state, had to reinforce the psychological aspects and allow the reincorporation of the mind-body pair into consciousness. During this section, the subject was made to visualize and envisage a future from another angle. Finally, the 2 last dives aimed to consolidate the feeling of confidence by valuing the personal capabilities and letting go.

Benefit/Risk Ratio:

Scuba diving generates certain physiological stresses related to immersion and pressure increases. The main risks are desaturation accidents related to the release of nitrogen in bubble form during decompression, barotrauma following variations in the gas volumes in the air cavities of the organism during depth variation, toxic accidents generated by the increase in the partial pressure of the ventilated gas when the ambient pressure increases and immersion pulmonary oedema (IPO) caused by heart overload and weakening of the lungs, usually related to an effort while immersed in cold water with an increase in ventilatory stress. Drowning can also occur in this situation. It is usually secondary to a technical incident, an equipment problem and/or loss of consciousness. In view of these factors, the protocol does not include any dive at a depth above 20 meters in order to reduce the risks of desaturation accidents and toxic accidents. To limit barotrauma accidents related to the failure to control descent and ascent speeds in beginners, the two first dives are done in swimming pools in order to easily evaluate the level of comfort and stress of the subjects and to form homogenous groups for dives in the sea. During the whole course, the depths intended to be reached are very gradual and the student/monitor ratio varies from 4 for 1, for subjects who are very comfortable, to 2 for 1 for the least aquatic, and to 1 for 1 for those exhibiting significant stress. Since depth has little impact on the successful completion of the protocol, all the session objectives can be achieved at a depth of 3 meters. Each monitor included in the program held a professional diploma, experience in the field of training in underwater activities and specific training in the management and physiopathology of stress. All the monitors had previously completed a sophrology training course.

Example 1—Evaluation of the Effects of the Ventilation Device on the Respiratory Frequency of the Subject Using the Ventilation Device (A) According to the Invention Introduction: mindful meditation and the Bathysmed protocol have the common objectives of controlling, and typically reducing, respiratory frequency by privileging the expiratory phase in order to modulate the cardiac frequency (preferably reduce it) and thus achieve a state of heart coherence. The objective of this work was to evaluate the effect of the ventilation device (A) on the respiratory parameters among healthy volunteer subjects.

Method: 20 adult volunteer subjects were evaluated. After a preliminary period of stationary lying down for a duration of 5 minutes, respiratory data were collected before and after 5 minutes of use of the ventilation device (A) in the half-sitting position at 45°. Among the data gathered were the respiratory frequency per minute, which has a usual average at rest of 15±2 per minute: the tidal volume (Vc), i.e. the lung volume for normal cycles at rest; and the capnia, which is the rate of expired $CO_2$, the latter being correlated with the minute ventilation.

Results: Between the reference period and that of the end of use of the device (A), the cardiac frequency dropped from 72±13 beats per minute to 64±5 beats per minute, the respiratory frequency dropped from 15±5 cycles per minute to 11±4 (FIG. 6), and the capnia (rate of expired $CO_2$) was reduced from 35±5 to 33±3 mm Hg (FIG. 7) following an increase in the tidal volume from 584±86 ml to 1100±382 ml (FIG. 8).

Conclusions: The use of the device (A) therefore promotes the state of heart coherence with a reduction in the cardiac frequency and in the respiratory frequency in association with an increase in the respiratory volumes (tidal volume), and with a drop in capnia among the test subjects. All these modifications are induced spontaneously in the test subjects using the ventilation device (A) according to the invention, i.e. independently of any intention or deliberate action of the test subjects.

Example 2—Evaluation of the Effects of the Virtual Reality System (Y) According to the Invention on Parameters Associated with Heart Coherence in a Subject Using Said System Introduction: The ventilation device (A) according to the invention can be integrated into a virtual reality system (Y) comprising means for replicating a sensory experience acting on the senses such as hearing, sight, touch, smell or position in space. The objective of this work was to evaluate the influence of the combination of these means on the beneficial physiological effects observed during use of the ventilation device (A) of the invention leading to the state of heart coherence in volunteer subjects, either healthy or suffering from PTSD.

Method: A mask for viewing a virtual reality content was placed on the eyes of the user of the virtual reality system (Y) according to the invention. The virtual reality system has the aim of simulating a scuba dive. Each session lasts from 15 to 30 minutes, in particular from 17 to 25 minutes. The conducting of successive sessions makes it possible to gradually bring the diving user to perform virtual dives at shallow depth (3/4 meters) then medium depth (10/15 meters).

While viewing any image, for example a blue background, the user heard a pre-session talk. After a session of sophrology/mental preparation of a duration of 2 to 3 minutes allowing the subject to become aware of his posture, stabilize his ventilation and acquire muscle relaxation, a film of a duration of approximately 15 minutes was projected to him using a virtual reality system (Y) according to the invention. Cardiac and respiratory data was collected at least before and after the conducting of the session of use of the virtual reality system, preferably before then throughout the session.

The film, divided into several phases of 1 to 5 minutes, for example includes the following sequences:

(a) user/diver at the surface, duration of approximately 1 minute: the user/diver is guided by a voice overlaid on the sound simulating breathing, (b) descent to a seabed, duration of approximately 1 minute, (c) pause on the sand, duration of approximately 1 minute: the user/diver contemplates the landscape and the sound simulating breathing is adjusted, (d) seeing of a monitor guiding the user by signs (movements to be made or poses to be taken for example), optionally in the presence of a voice-over, followed by a series of exercises starting with approximately 1 minute during which the user/diver closes his eyes and turns his attention to the sound and the depth of his breathing. Then the user/diver re-opens his eyes when a previously determined sound is emitted and observes the monitor performing a demonstration of the exercises to then be applied (i.e. sophrology exercises 1 to 4 of the "BTY" protocol). The user/diver closes his eyes again and lets himself be guided by a voice-over or a series of sounds for approximately 3 to 7 minutes, (e) quiet walk around, duration approximately 4 to 5 minutes, (f) pause on the sand before the re-ascent, duration approximately 1 minute: the diver watches the surface before starting to reascend, takes a few restimulation inspirations and reascends to the surface, and (g) arrival at the surface, quiet time during which a voice-over directs the attention of the diver to the water-surface transition, duration approximately 1 minute.

During step (d), the exercise of a duration of approximately 2 to 4 minutes have the aim of making the user aware of his five senses and/or all or part of his body by way of images of his own palms moving and/or images of 3D motion or rotation.

As a function of the depth of the descent done in step (b), i.e. 3/4 m, 10 m or 15 m maximum, the quiet walk around of step (e) is for example done in reefs of 5/6 m with views of the surface, in reefs of 7/8 m and/or at the edge of a drop or a slope.

The first session or first two sessions are done without entering the water (virtual), unlike the following sessions where virtual entry into the water is done from a boat for example by a straight jump for a duration of approximately one minute prior to step (a).

The more sessions the user/diver performs, the more he will be proposed varied exercises such as for example apnea exercises (for example a sequence of steps comprising a step of ventilation with full respiratory cycles then a step of apnea lasting 20 seconds then a step of recovery by ventilation with full respiratory cycle(s) lasting 40 to 60 seconds), where applicable coupled to the visualization of bubbles breathed out by the user/diver, or positive diving visualization exercises by an alternation of opening/closing of the eyes of the user/diver.

Results: A state of heart coherence is attained among users of the virtual reality system (Y) of the invention and/or the beneficial effects related to this state persist for at least 1 month, preferably at least 3 months, still preferably at least 6 months after the sessions are conducted.

Example 3—Evaluation of the Effects of the Virtual Reality System (Y) According to the Invention on the Cardiac Frequency (Heart Rate) in a Subject Using Said System The cardiac frequency of a subject who has never undergone any virtual reality experience was measured before and during the use of a virtual reality system (Y) according to the invention (see FIG. 10).

The followed protocol comprised the following steps:

1) subject at rest [not equipped with the system (Y)]: the phase lasts 3 minutes, the time it takes to allow the subject to return to his resting heart rate;

2) the subject uses the system (Y) according to the invention during approximately 5 minutes: he views a film using a tool (B), breathes through the mouthpiece of the device (A) but has no sound feedback. After a first phase of adaptation, his heart rate stabilizes at a level lower than his resting heart rate;

3) the audio module (D) located in the system (Y) is engaged. This step lasts approximately 5 minutes:

after a phase of adaptation, the heart rate of the subject further decreases to reach the lowest level of the experiment, thus allowing the subject to tend toward a state of heart coherence.

REFERENCES

1—Cohen S, Kamarck T, Mermelstein R. Cohen S, et al. J Health Soc Behav. 1983 December; 24(4):385-96.

2—Cohen S, Janicki-Deverts D, Miller G E. JAMA. 2007 Oct. 10; 298(14):1685-7.

3—Shalev A, Liberzon I, Marmar C. Post-Traumatic Stress Disorder N Engl J Med. 2017 Jun. 22; 376(25):2459-2469.

4—Wachen J S, Shipherd J C, Suvak M, Vogt D, King L A, King D W. J Trauma Stress. 2013 June; 26(3):319-28.

5—Stephenson K R, Simpson T L, Martinez M E, Kearney D J. J Clin Psychol. 2017 March; 73(3):201-217.

6—Khirreddine I, *Lema*ître A, Homère J, Plaine J, Garras L, Riol M-C, et al. La souffrance psychique en lien avec le travail chez les salariés actifs en France entre 2007 and 2012, à partir du programme MCP. Bull Épidémiologique Hebd. 2015; (23):431.

7—Moukarzel A, Michelet P, Durand A C et al. Burnout syndrome among emergency department staff: prevalence and associated factors. Biomed Res Int. 2019 Jan. 21; 2019: 6462472.

8—Lavoute C, Weiss M, Rostain J C. Brain Res. 2005 Sep. 14; 1056(1):36-42.

9—Lavoute C, Weiss M, Risso J J, Rostain J C. Neurochem Res. 2012 March; 37(3):655-64.

10—Beneton F., Michoud G., Coulange M., et al. (2017). Recreational diving practice for stress management: an exploratory trial. Front. Psychol. 8:2193.

11—Hariri, A. R., Bookheimer, S. Y., & Mazziotta, J. C. (2000). Modulating emotional responses: effects of a neocortical network on the limbic system. NeuroReport, 11, 43-48.

12—Heckenberg R A, Eddy P, Kent S, Wright B J., J Psychosom Res. 2018 November; 114:62-71.

13—Greeson, J. M. (2009). Mindfulness research update: 2008. Complemental Health Practice Review, 14, 10-18.

14—Ditto, B., Eclache, M., & Goldman, N. (2006). Short-term autonomic cardiovascular effects of mindfulness body scan meditation. Annals of Behavioral Medicine, 32, 227-234.

15—Trousselard M, Steiler D, Claverie D, Canini F. Encephale. 2014 December; 40(6):474-80.

16—Ruiz-Fernández MD, Ortíz-Amo R, Ortega-Galán ÁM, Ibáñez-Masero O, Rodríguez-Salvador MDM, Ramos-Pichardo J D. Int J Ment Health Nurs. 2020 April; 29(2):127-140.

17—Jayatunge R M, Pokorski M. Post-traumatic Stress Disorder: A Review of Therapeutic Role of Meditation Interventions. Adv Exp Med Biol. 2019; 1113:53-59.

The invention claimed is:

1. A ventilation device for ventilating a subject, said device comprising: an oral or oronasal endpiece or an orofacial mask and i) a valve or ii) an inspiration valve and an expiration valve, the valve or inspiration and expiration valves being configured to impose on the subject an expiratory effort greater than the subject's inspiratory effort, inspiration pressure values being between 0 and 10 mbar of resistance, and expiration pressure values being between 1 and 12 mbar of resistance, the pressure values being expressed as an absolute value, wherein the ventilation device further comprises an audio module, said audio module being integrated in, or connected to: the ventilation device and a device for receiving, storing, processing and/or transmitting data acquired by the ventilation device wherein:

the audio module is configured to reduce or cancel surrounding noises and/or to play a sound essentially identical to a sound generated during the use of a scuba diving regulator;

the ventilation device comprises a sensor;

the device for receiving, storing, processing and/or transmitting data acquired by the ventilation device is connected to the sensor of the ventilation device and to the audio module; and the audio module plays inspiratory and expiratory sounds in a way that is synchronized with inspiratory and expiratory ventilation of the subject, wherein the audio module comprises an audio file reader and a memory card, said memory card comprising a first sound file for playing an inspiratory sound and a second sound file for playing an expiratory sound;

the sensor is a pressure and/or flow rate sensor which delivers a signal; and the device for receiving, storing, processing and/or transmitting data acquired by the ventilation device comprises a processor or a microcontroller which:

i) analyses the signal delivered by the pressure and/or flow rate sensor by comparing a pressure value obtained by the pressure and/or flow rate sensor with at least two previously determined pressure thresholds, ii) transmits a signal to the audio file reader which triggers or stops the reading of the first or second sound file according to an inspiratory or expiratory nature of a phase of ventilation in which the subject is by adapting intensity of a sound volume as a function of the difference at the two previously determined thresholds, and iii) records the signal(s) delivered by the sensor and/or transmitted to the audio file reader.

2. The ventilation device according to claim 1, wherein the audio module is configured to reduce or cancel surrounding noise and to play a sound essentially identical to a sound generated during the use of a scuba diving regulator under real diving conditions.

3. The ventilation device according to 1, wherein the ventilation device comprises, or is connected to, one or more additional sound files for playing one or more sounds at a moment of the inspiration and/or the expiration of the subject, or continuously during a respiratory cycle of the subject, and/or comprises, or is connected to, one or more files forming a medium for a visual content and where applicable forming a medium or media for the sound associated with said visual content.

4. A system comprising:

the ventilation device for ventilating a subject according to claim 1;

a chamber or tubular network for modulating the temperature of all or part of the scalp of the subject and/or electrodes for delivering and/or generating electrical impulses across all or part of the scalp of the subject.

5. A virtual reality system comprising:

the ventilation device for ventilating a subject according to claim 1; and a tool for viewing a virtual reality content and/or an audio module for listening to a virtual reality content, wherein the tool for viewing a virtual reality content comprises a screen and a number of lenses.

6. The virtual reality system according to claim 5, wherein the tool for viewing a virtual reality content comprises an integrated operating system or is connected to a tool for playing a virtual reality content, the tool for playing a virtual reality content being selected from a computer, a memory card, a games console, a smartphone and/or the Internet.

* * * * *